US011549308B2

(12) United States Patent
Luo et al.

(10) Patent No.: US 11,549,308 B2
(45) Date of Patent: Jan. 10, 2023

(54) WINDOW BLIND

(71) Applicant: Nien Made Enterprise Co., Ltd., Taichung (TW)

(72) Inventors: Lei Luo, Taichung (TW); Lin Chen, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 78 days.

(21) Appl. No.: 17/023,338

(22) Filed: Sep. 16, 2020

(65) Prior Publication Data

US 2021/0222487 A1 Jul. 22, 2021

(30) Foreign Application Priority Data

Jan. 22, 2020 (TW) ..... 109201079

(51) Int. Cl.
*E06B 9/307* (2006.01)
*E06B 9/326* (2006.01)
*E06B 9/322* (2006.01)

(52) U.S. Cl.
CPC ..... *E06B 9/307* (2013.01); *E06B 9/322* (2013.01); *E06B 9/326* (2013.01); *E06B 2009/3225* (2013.01)

(58) Field of Classification Search
CPC ..... E06B 9/303; E06B 9/307; E06B 9/382; E06B 9/384; E06B 2009/3222; E06B 2009/3225; E06B 9/326; E06B 9/322; E06B 9/32
See application file for complete search history.

(56) References Cited

U.S. PATENT DOCUMENTS 2,397,765 A * 4/1946 Sylvanus ..... E06B 9/305 160/176.1 R
4,643,238 A * 2/1987 Tachikawa ..... E06B 9/307 160/178.1 R
5,692,552 A 12/1997 Judkins
5,806,579 A * 9/1998 Judkins ..... E06B 9/262 160/84.05

(Continued)

FOREIGN PATENT DOCUMENTS

EP 3 483 379 A1 5/2019
JP 2004-360453 A 12/2004

(Continued)

*Primary Examiner* — Daniel P Cahn
*Assistant Examiner* — John W Hanes, Jr.
(74) *Attorney, Agent, or Firm* — Winston Hsu

(57) ABSTRACT

A window blind includes a housing, a slat assembly, a slat angle adjusting device, and a first cord. The slat assembly is provided below the housing, and has multiple slats and a bottom end portion. The slat angle adjusting device includes a rotating shaft assembly provided in the housing, and a ladder assembly which includes at least two ladders connected to the rotating shaft assembly for turning the slats. The first cord passes on a front or a rear side of the slats, and connects the rotating shaft assembly and the bottom end portion. Throughout the duration of the rotation of the rotating shaft assembly, the first cord and a warp, which belongs to the ladder assembly and on the same side as the first cord, are both reeled into or out of the housing concurrently, and the slats and the bottom end portion are all rotated concurrently as well.

22 Claims, 31 Drawing Sheets

(56) References Cited

U.S. PATENT DOCUMENTS

| | | | | |
|---|---|---|---|---|
| 5,839,494 | A | 11/1998 | Judkins | |
| 6,976,522 | B2 * | 12/2005 | Strand | E06B 9/308 160/176.1 R |
| 2005/0045279 | A1 | 3/2005 | Zhang | |
| 2016/0123073 | A1 | 5/2016 | Chen | |
| 2017/0138123 | A1 | 5/2017 | Chen | |
| 2017/0292321 | A1 | 10/2017 | Chen | |
| 2017/0292322 | A1 * | 10/2017 | Chen | B65H 75/4492 |
| 2018/0112460 | A1 * | 4/2018 | Huang | E06B 9/326 |
| 2018/0171704 | A1 | 6/2018 | Chang | |
| 2019/0071925 | A1 * | 3/2019 | Zhang | E06B 9/307 |
| 2019/0112871 | A1 * | 4/2019 | Huang | E06B 9/322 |
| 2019/0145162 | A1 | 5/2019 | Chou | |

FOREIGN PATENT DOCUMENTS

| | | | |
|---|---|---|---|
| JP | 2012-132312 | A | 7/2012 |
| JP | 3206027 | U | 8/2016 |
| JP | 2018-71209 | A | 5/2018 |
| JP | 2018-193753 | A | 12/2018 |

* cited by examiner

WINDOW BLIND

BACKGROUND OF THE DISCLOSURE

1. Field of the Disclosure

The present disclosure relates generally to a window blind, and more particularly to a window blind that could have its slats fully closed.

2. Description of the Prior Art

An ordinary window blind usually has a headrail, a bottom rail, and a plurality of slats provided between the headrail and the bottom rail. The operations a window blind could provide include lifting and lowering the slats and changing the tilt angles thereof. By lifting and lowering the window blind, the total area covered by the slats can be adjusted; by changing the tilt angles of the slats, the sizes of the gaps between slats can be adjusted to determine how much light could pass through.

However, it is not uncommon for a conventional window blind, especially a cordless one, to be unable to achieve a completely closed state (i.e., to provide a full light-blocking effect) while adjusting the gaps between slats. For instance, a window blind that only has conventional ladders is prone to have irregularly arranged slats. When the slats are supposed to be completely closed, there may still be light leaking in on left or right sides. In another example, for a window blind which not only has ladders but also lifting cords, the lengths of its lifting cords will be fixed and no longer changeable once the window blind is completely lowered. At this time, if the slats are going to be turned to a fully closed position, the fixed lengths of the lifting cords will hinder the turning of the bottom rail. This problem is particularly obvious if the lifting cords are provided on the front and rear sides of the slats. Specifically speaking, after the slat assembly is fully expanded, the lengths of the lifting cords on the front and rear sides are fixed. If the slats are to be rotated to a fully closed position, the warps of each of the ladders must have a relative vertical movement. However, since the lengths of the lifting cords are not changeable in such condition, the bottom rail will not be allowed to rotate to a fully closed position. As a result, the slats near the bottom rail may not be able to rotate to a fully closed position as well, leading to an unsatisfactory closing effect for the window blind.

SUMMARY OF THE DISCLOSURE

In view of the known problem mentioned above, one aspect of the present disclosure is to provide a window blind that provides a slat assembly, of which the bottom end portion could rotate all the way along with the rotation of the slats. In other words, the turning of the bottom end portion of the slat assembly would not be hindered by the fixed lengths of the lifting cords. In this way, the window blind provided in the present disclosure could solve certain problems, including the imperfect closing effect for window blind slats and the unwanted light leakage.

The present disclosure provides a window blind, which includes a housing, a slat assembly, and a slat angle adjusting device. The housing is defined to have a longitudinal axis, a lateral axis, and a vertical axis, wherein the longitudinal axis and the lateral axis are perpendicular to each other, and are both on a same horizontal plane; the vertical axis is perpendicular to the longitudinal axis, and is in a same direction as a normal of the horizontal plane; the longitudinal axis passes through lateral sides of the housing, the lateral axis passes through front and rear sides of the housing, and the vertical axis passes through top and bottom sides of the housing. The slat assembly is provided below the housing, wherein the slat assembly includes a plurality of slats and a bottom end portion; the bottom end portion is located below the slats so that the slats are between the bottom end portion and the housing. The slat angle adjusting device includes a rotating shaft assembly, a ladder assembly, and a first cord. The rotating shaft assembly is provided in the housing and is parallel to the longitudinal axis. The ladder assembly includes at least two ladders, wherein each of the ladders has a front warp and a rear warp; both the front warp and the rear warp are provided in a direction parallel to the vertical axis and are spaced apart from each other. A plurality of wefts are provided at intervals between the front warp and the rear warp, making each of the ladders have a ladder shape. Each weft is provided with one of the slats, so that the slats are arranged in the direction parallel to the vertical axis at intervals between the front warp and the rear warp. The front warp and the rear warp are connected to the rotating shaft assembly to be driven by the rotating shaft assembly to create a relative movement in the direction parallel to the vertical axis, whereby to drive the slats to turn. The first cord passes on one of a front side and a rear side of the slats, wherein a top end of the first cord is concurrently movable along with the rotating shaft assembly, and a bottom end of the first cord is connected to the bottom end portion. When the rotating shaft assembly is driven to rotate, the first cord and the front warps or the rear warps of the ladder assembly which is on a same side as the first cord are concurrently reeled into or released out from the housing throughout a rotation of the rotating shaft assembly, and the slats and the bottom end portion are also concurrently rotated throughout the rotation of the rotating shaft assembly.

In an embodiment, at least one of the ladders has a plurality of thread loops provided on one of the front warp and the rear warp; each of the slats has a perforation corresponding to one of the thread loops; the first cord, in a direction parallel to the vertical axis, sequentially passes through all of the thread loops, each of which has passed through the corresponding one of the perforations, whereby to restrict the slats from moving relative to the ladder assembly in directions parallel to the longitudinal axis.

In an embodiment, the rotating shaft assembly includes a rotating shaft, a first rotating member, a second rotating member, and a third rotating member. The rotating shaft is located in the housing in a direction parallel to the longitudinal axis. The first rotating member, the second rotating member, and the third rotating member are provided in a manner that each of them is concurrently movable along with the rotating shaft. Top ends of the front warp and the rear warp of one of the ladders are respectively connected to the first rotating member, while top ends of the front warp and the rear warp of another one of the ladders are respectively connected to the second rotating member. The top end of the first cord is connected to the third rotating member. When the rotating shaft is driven to rotate, the first rotating member, the second rotating member, and the third rotating member are rotated along with a rotation of the rotating shaft.

In an embodiment, the window blind further includes a second cord, wherein the second cord passes on the other one of the front side and the rear side of the slats opposite to the first cord. A top end of the second cord is concurrently movable along with the rotating shaft assembly, and a bottom end of the second cord is connected to the bottom end portion of the slat assembly. When the rotating shaft assembly is driven to rotate, the second cord and the front warps or the rear warps of the ladder assembly which is on a same side as the second cord are concurrently reeled into or released out from the housing throughout the rotation of the rotating shaft assembly.

In an embodiment, the rotating shaft assembly includes a rotating shaft, a first rotating member, a second rotating member, a third rotating member, and a fourth rotating member. Top ends of the front warp and the rear warp of one of the ladders are concurrently movable along with the first rotating member, while top ends of the front warp and the rear warp of another one of the ladders are concurrently movable along with the second rotating member. The top end of the first cord is concurrently movable along with the third rotating member. The top end of the second cord is concurrently movable along with the fourth rotating member. When the rotating shaft is driven to rotate, the first rotating member, the second rotating member, the third rotating member, and the fourth rotating member are rotated along with a rotation of the rotating shaft.

In other embodiments, the third rotating member and the first rotating member are integrally made as a first rotating drum; or, the third rotating member, the fourth rotating member, and the first rotating member are integrally made as a first rotating drum; or, the third rotating member and the first rotating member are integrally made as a first rotating drum; the second rotating member and the fourth rotating member are integrally made as a second rotating drum.

In an embodiment, in the first rotating drum, the third rotating member and the fourth rotating member are connected. The top end of the first cord and the top end of the second cord are connected. The front warp and the rear warp of one of the ladders are respectively provided at the first rotating member in a non-movable manner. A segment of the first cord near the top end thereof is wound around the third rotating member in a manner that said segment is non-movable relative to the third rotating member. A segment of the second cord near the top end thereof is wound around the fourth rotating member in a manner that said segment is non-movable relative to the fourth rotating member. When the rotating shaft is driven to rotate, the first rotating drum drives the first cord and the second cord to create a relative movement along with the front warps and the rear warps which also have a relative movement.

In an embodiment, the top end of the first cord and the top end of the second cord are connected. The first cord passes by the third rotating member, and the second cord passes by the fourth rotating member. When the rotating shaft is driven to rotate, the first cord and the second cord create a relative movement along with the front warps and the rear warps which also have a relative movement.

In an embodiment, the third rotating member and the fourth rotating member are integrally made to form a cord rotating drum. When the rotating shaft is driven to rotate, the cord rotating drum, the first rotating member, and the second rotating member are rotated along with the rotating shaft to make the front warps and the rear warps of the ladder assembly create a relative movement, and to drive the first cord and the second cord to create a relative movement as well.

With the design mentioned above, the window blind provided in the present disclosure has the following advantages:

(1) Through the cooperation between the first cord and the thread loops of the corresponding ladder, the slats could be prevented from moving from side to side in a direction parallel to the longitudinal axis, and therefore there would be no lateral misalignments, which could avoid the problem that irregular light leakage may happen on lateral sides of the slat assembly even when the slats are entirely closed;

(2) With the structural arrangement described above, the first cord (and the second cord) could correspondingly create a relative vertical movement along with the front warp and the rear warp of the corresponding ladder while the rotating shaft is being rotated, so that the bottom end portion (i.e., the bottom rail) could be rotated as well throughout the whole process of adjusting the tilt angle of the slats, whereby to prevent the problem that the slats may be imperfectly closed due to the fixed-length cords. Furthermore, the bottom end portion (i.e., the bottom rail) could gently and smoothly change its tilt angle along with the slats while the tilt angle of the slats is being adjusted.

These and other objectives of the present disclosure will no doubt become obvious to those of ordinary skill in the art after reading the following detailed description of the preferred embodiment that is illustrated in the various figures and drawings.

BRIEF DESCRIPTION OF THE DRAWINGS

The present disclosure will be best understood by referring to the following detailed description of some illustrative embodiments in conjunction with the accompanying drawings, in which.

DETAILED DESCRIPTION

Figure 1:
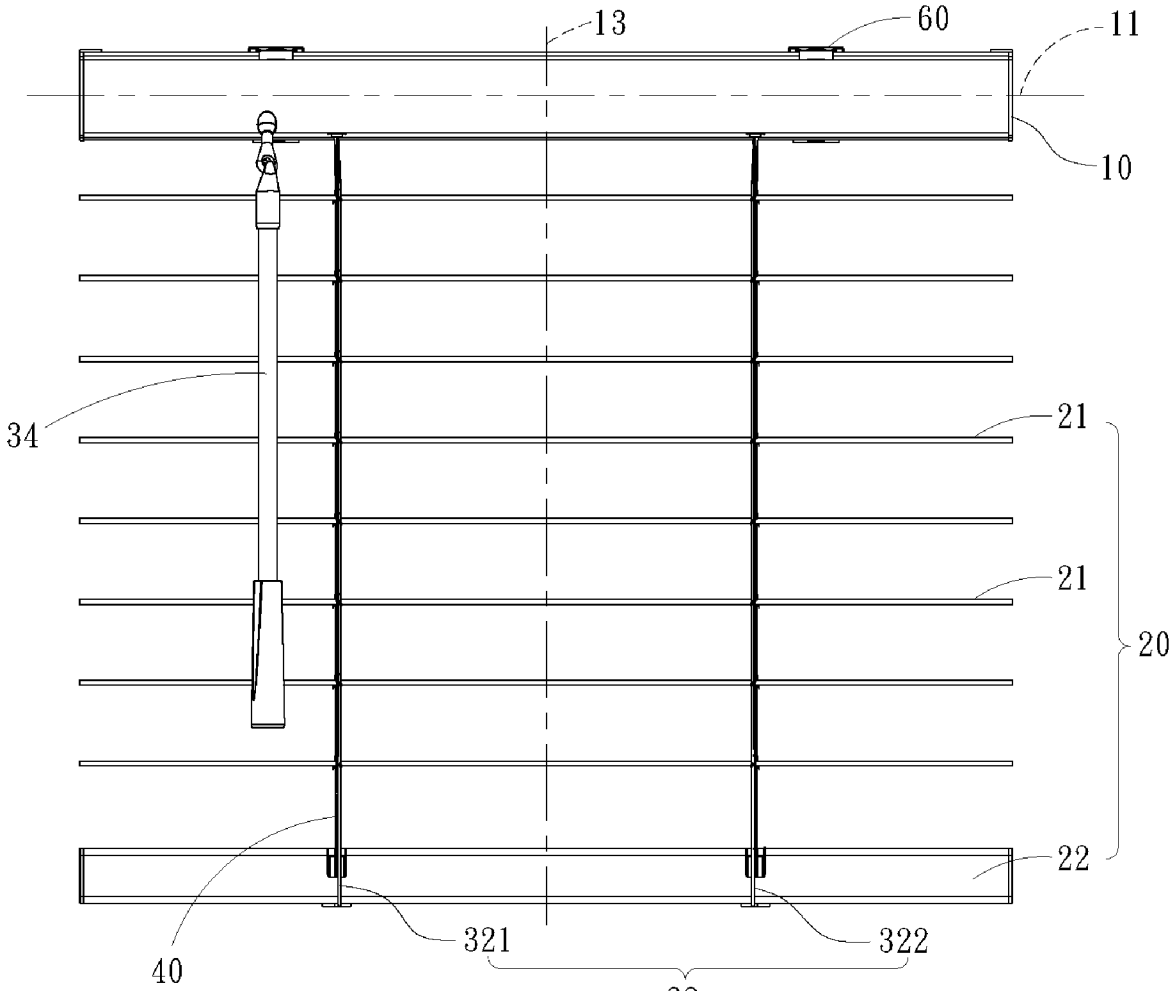
FIG. 1 is a front view of the window blind of a first embodiment of the present disclosure, showing the condition that the slat assembly is fully expanded and the slats are horizontally arranged.
Figure 2:
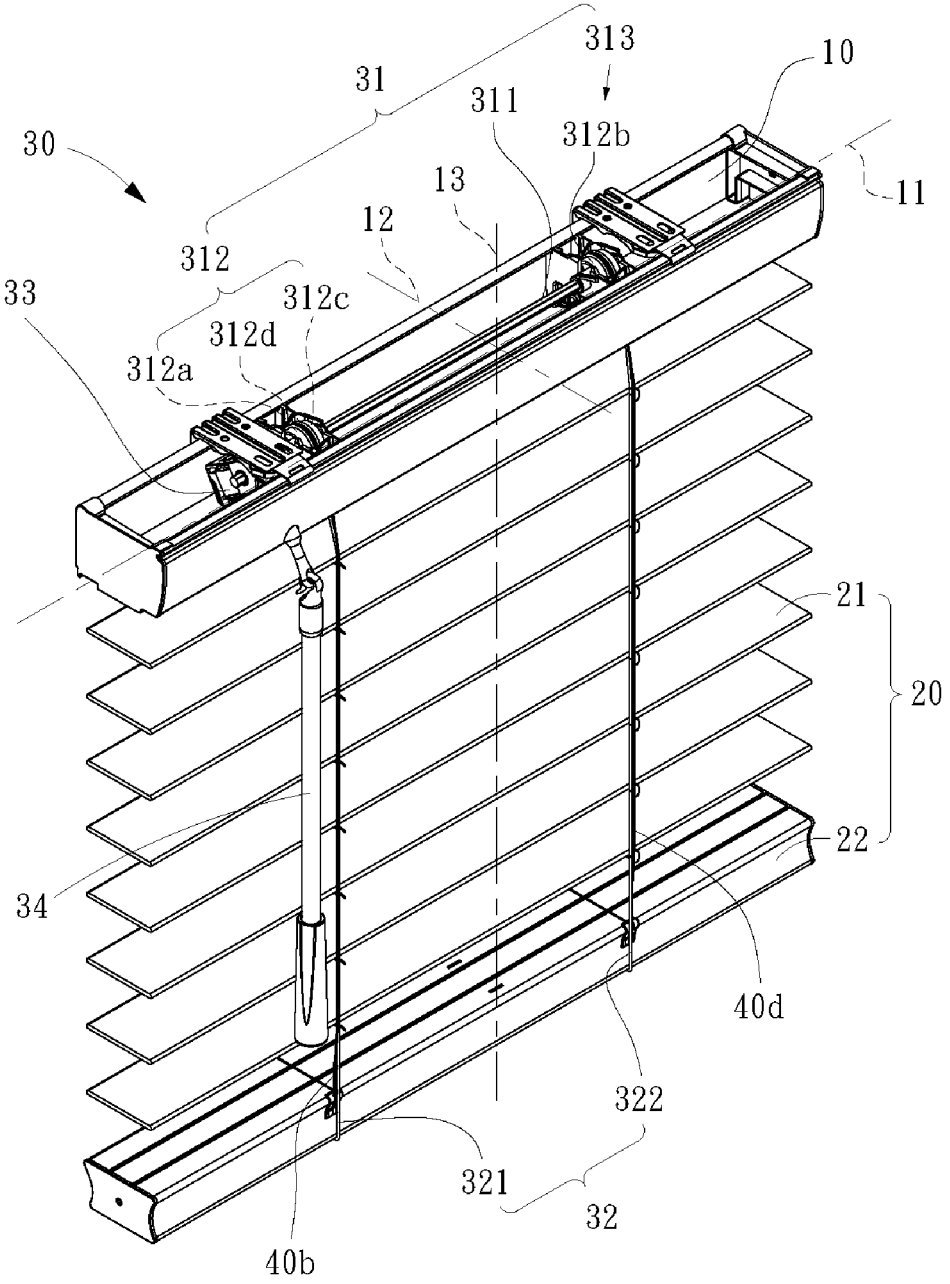
FIG. 2 is a perspective view of FIG. 1 seen from a different angle.

As shown in FIG. 1 and FIG. 2, a window blind provided in the present disclosure includes a housing 10, a slat assembly 20, a slat angle adjusting device 30, and a cord assembly 40. Said housing 10 is a substantially hollow cuboid with a receiving space inside. Herein we define a longitudinal axis 11, a lateral axis 12, and a vertical axis 13, wherein the longitudinal axis 11 passes through left and right sides of the housing 10; the lateral axis 12 and the longitudinal axis 11 are perpendicular to each other, and share a same horizontal plane. Furthermore, said lateral axis 12 passes through front and rear surfaces of the housing 10. The vertical axis 13 is parallel to a normal direction of the horizontal plane shared by the longitudinal axis 11 and the lateral axis 12; in other words, the vertical axis 13 passes through top and bottom surfaces of the housing 10. That means the longitudinal axis 11, the lateral axis 12, and the vertical axis 13 are parallel to the directions of length, width, and height of the housing 10, respectively.

The slat assembly 20 is provided below the housing 10, wherein said slat assembly 20 includes a plurality of slats 21 and a bottom end portion 22. The bottom end portion 22 is located below a bottommost position of the slats 21, and corresponds to the housing 10 with the slats 21 located in between. The bottom end portion 22 of the slat assembly 20 can be simply a long plate, or can be a structure similar to that of the slats 21. In the current embodiment, the bottom end portion 22 is a hollow cuboid similar to the housing 10, and could have necessary mechanisms and counterweight received therein if required.

Figure 10:
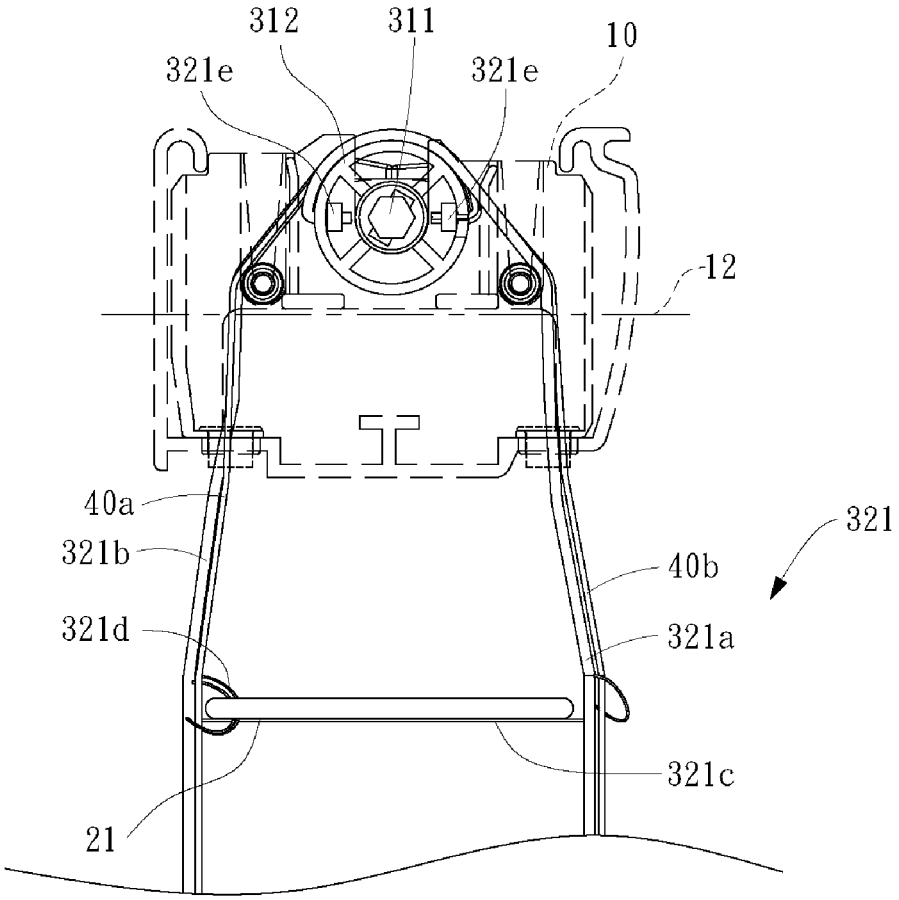
FIG. 10 is a left side view showing part of FIG. 1.

The slat angle adjusting device 30 includes a rotating shaft assembly 31, a ladder assembly 32, a direction-changing mechanism 33, and a control member 34. The rotating shaft assembly 31 is disposed in the receiving space of the housing 10 in a direction parallel to the longitudinal axis 11. The ladder assembly 32 includes two ladders 321, 322 spaced apart from each other. Take the ladder 321 on the left side in FIG. 1 and FIG. 2 as an example: the ladder 321 has, as shown in FIG. 10, a front warp 321*a* and a rear warp 321*b* which are provided in a manner that they are parallel to the vertical axis 13, perpendicular to the lateral axis 12, and spaced apart from each other. A plurality of wefts 321*c* are provided at intervals in a direction parallel to the vertical axis 13 between the front warp 321*a* and the rear warp 321*b*, giving the ladder 321 a ladder-like outlook. Each of the wefts 321*c* has one of the slats 21 resting thereupon, so that the slats 21 are arranged at intervals between the front warp 321*a* and the rear warp 321*b*, sequentially away from the housing 10, and in a direction parallel to the vertical axis 13.

The control member 34 is connected to the direction-changing mechanism 33, and the direction-changing mechanism 33 is connected to the rotating shaft assembly 31. By maneuvering the control member 34, the direction-changing mechanism 33 could be driven to operate, driving the rotating shaft assembly 31 to force the ladder assembly 32 to change a light-blocking angle (i.e., a tilt angle) of the slats 21. It has to be clarified that, in order to firmly and steadily hold slats of a window blind, a ladder assembly is usually provided with at least two ladders, and there can be even more ladders for a wide slat assembly. In the current embodiment, there are two ladders, i.e., as shown in FIG. 1, the ladder 321 on the left side and the ladder 322 on the right side. However, this is not a limitation of the present disclosure. Furthermore, the structural arrangement of the ladder 322 on the right side of FIG. 1 is basically the same with that of the ladder 321 on the left side, and therefore we are not going to describe it in detail herein.

Figure 3:
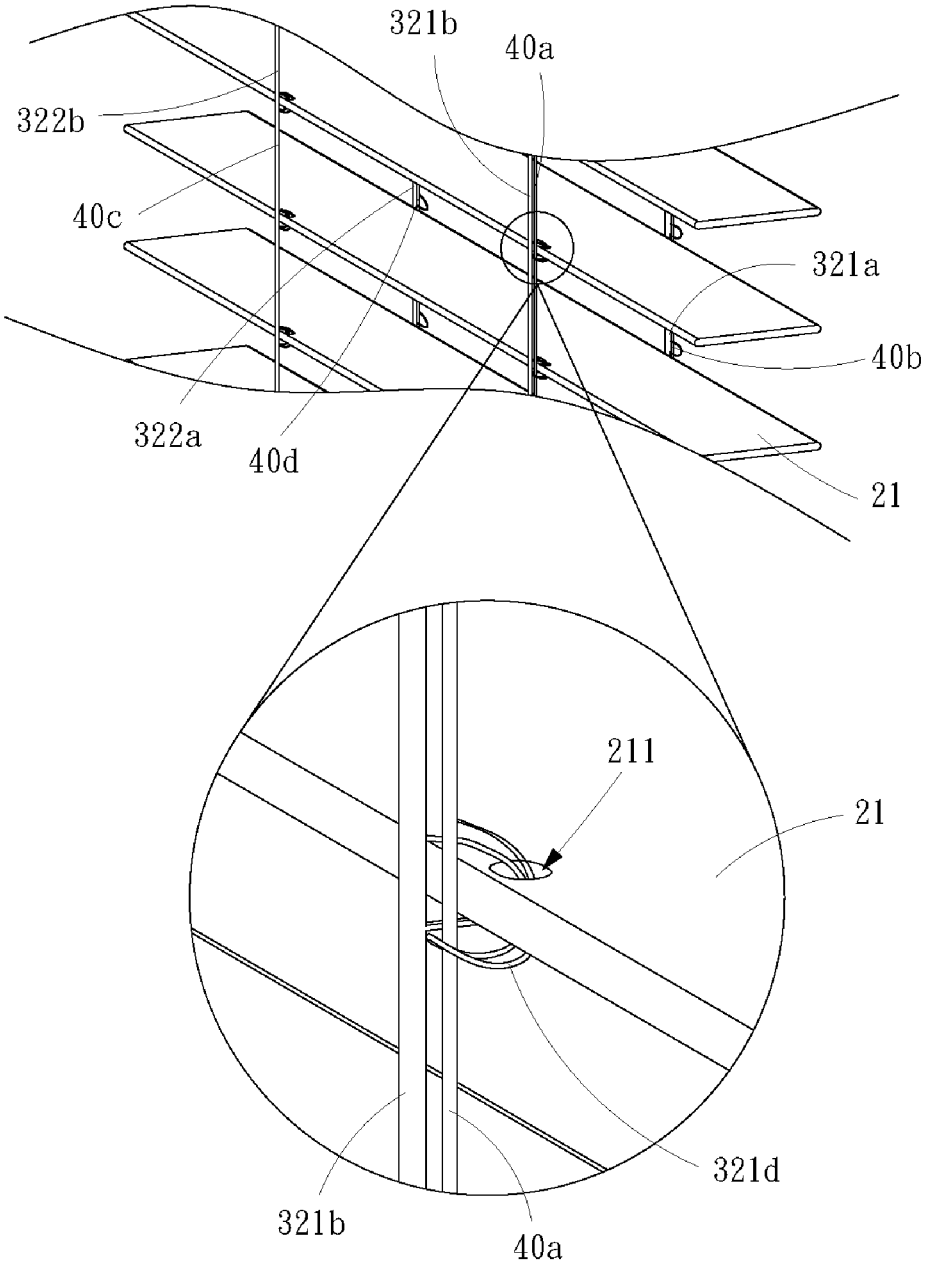
FIG. 3 is an enlarged view extracted from the perspective view of the rear side of FIG. 1, showing the arrangement that the first cord passes through the thread loops, each of which has already passed through the perforation of the corresponding one of the slats.
Figure 4:
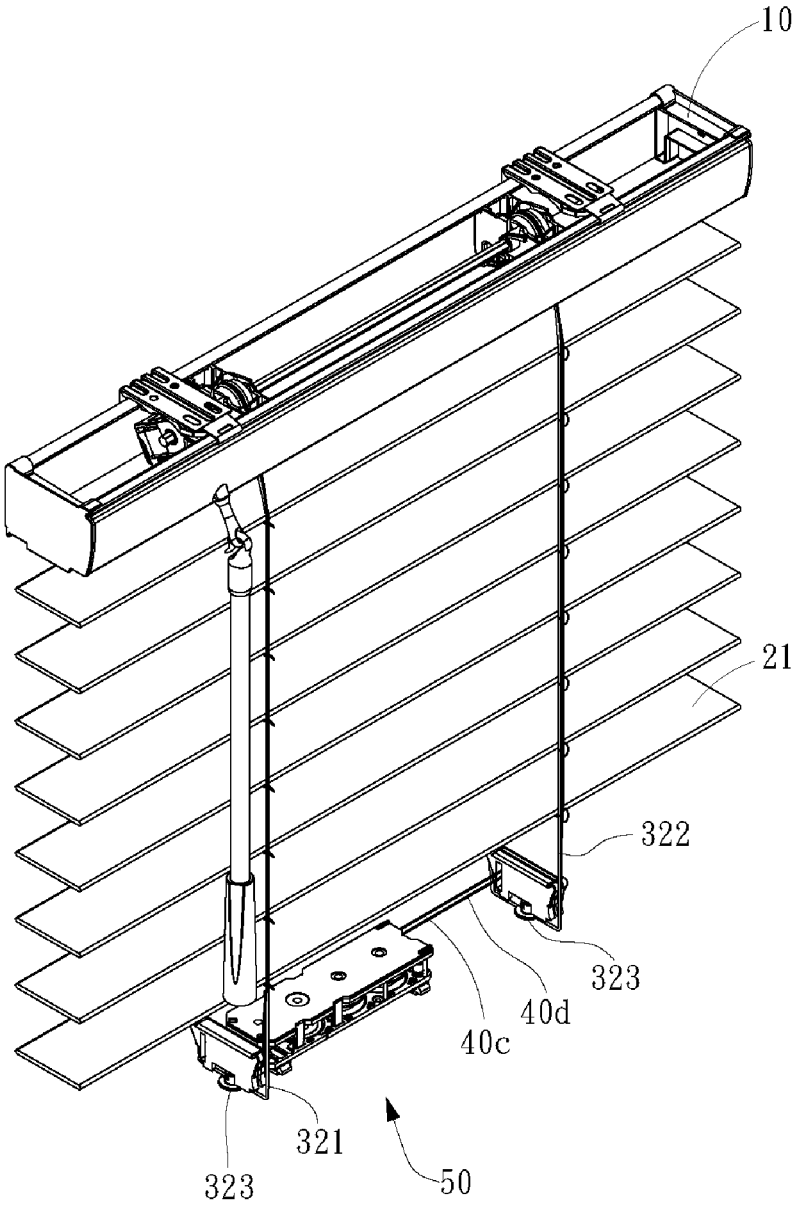
FIG. 4 is a schematic view similar to FIG. 2, but the outer casing of the bottom end portion is omitted to reveal the arrangement that the lifting device is provided at the bottom end portion.
Figure 5:
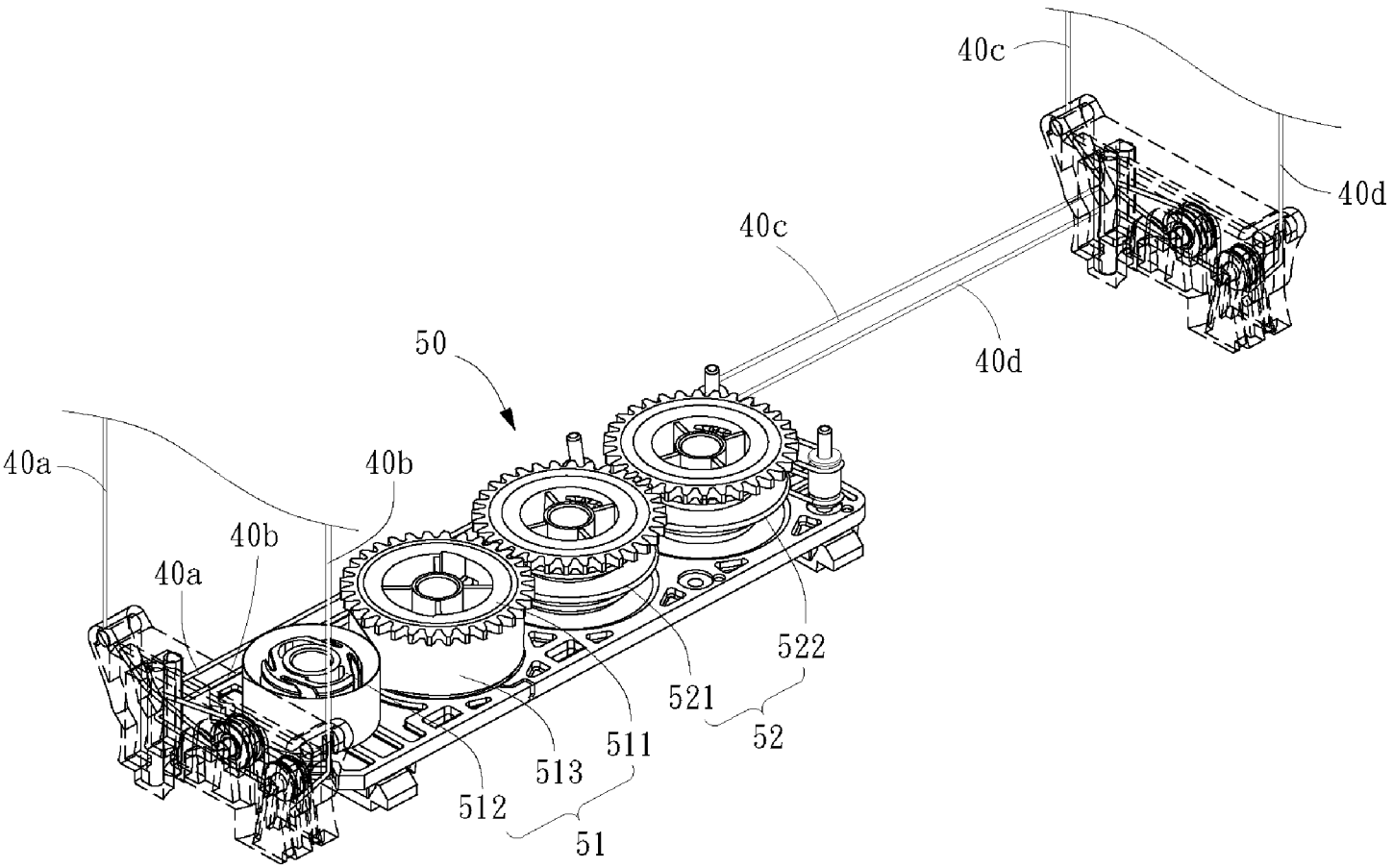
FIG. 5 is a schematic view of the lifting device of FIG. 4.
Figure 6:
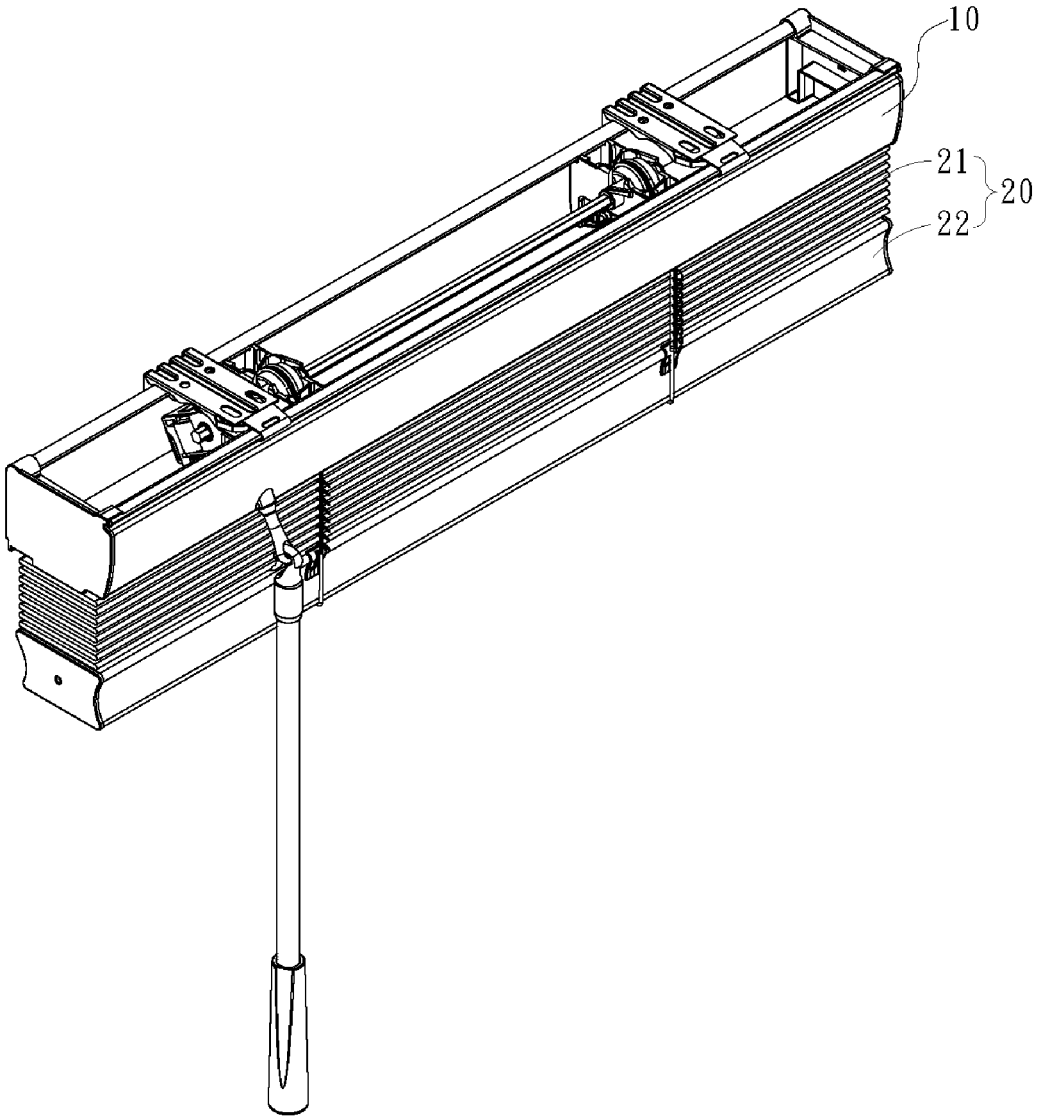
FIG. 6 is a perspective view of the window blind of the first embodiment of the present disclosure, showing the condition that the slat assembly is fully collapsed (i.e., gathered)
Figure 11:
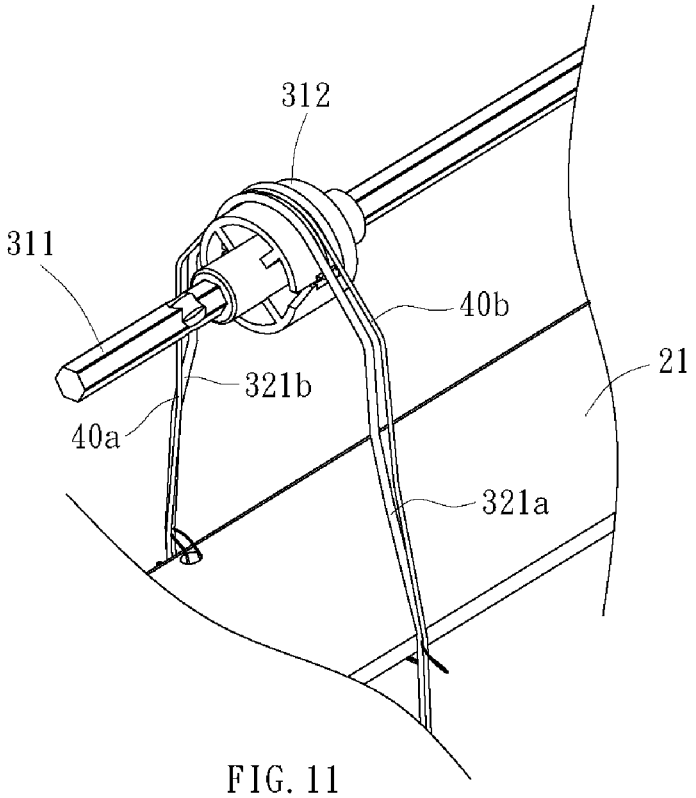
FIG. 11 is an enlarged perspective view of FIG. 10, showing the arrangement of the first rotating drum, the ladders, and the cord assembly.

The structural details of the window blind of the current embodiment are disclosed in FIG. 1 to FIG. 14. Herein we define that the slat assembly 20 has a front side and a rear side; an extension line of the lateral axis 12 intersects extension planes on the front and rear sides, which are parallel to the longitudinal axis 11 and the vertical axis 13. The cord assembly 40 includes a first cord 40*a* passing on the rear side of the slats 21 of the slat assembly 20, and adjacent to the rear warp 321*b* of the ladder 321, as shown in FIG. 10 and FIG. 11. It is worth mentioning that the rear warp 321*b* of said ladder 321 could be further, but not limited to, provided with a plurality of thread loops 321*d*; on the other hand, each of the slats 21 could be further, but also not limited to, provided with a perforation 211 corresponding to one of the thread loops 321*d*. This is the case in the current embodiment, wherein each of the thread loops 321*d* passes through the perforation 211 of the corresponding slat 21, and the first cord 40*a* passes through all of the thread loops 321*d* that already passed through the perforations 211, as shown in FIG. 3. With such design, the slats 21 could be restricted from moving relative to the ladder 321 in a direction parallel to the longitudinal axis 11. As a result, the window blind of the current embodiment would not have the problem that the slats 21 may be misaligned on lateral sides and therefore create irregular light leakage even when they are closed.

Herein we are going to further explain the design and the arrangement of the rotating shaft assembly 31 of the current embodiment of the present disclosure. The rotating shaft assembly includes a long, rod-like rotating shaft 311, of which a cross-section is a non-circular shape. Furthermore, said rotating shaft assembly 31 includes a first rotating member 312*a* and a second rotating member 312*b*, which both fit around the rotating shaft 311. The ladder 321 of the ladder assembly 32 has a top end connected to the first rotating member 312*a*, and a bottom end fixed to the bottom end portion 22 through a cord anchor 323. Similarly, the other ladder 322 has a top end connected to the second rotating member 312*b*, and a bottom end fixed to the bottom end portion 22 through another cord anchor 323 as well. A third rotating member 312*c* is further provided near the first rotating member 312*a*, and also fits around the rotating shaft 311, as shown in FIG. 2. Take the components on the left side in FIG. 1 and FIG. 2 as an example: the front warp 321*a* and the rear warp 321*b* of the ladder 321 are connected to the first rotating member 312*a*, and the first cord 40*a* is connected to the third rotating member 312*c*. In addition, the cord assembly 40 could further include a second cord 40*b*, which is connected to a fourth rotating member 312*d*, as shown in FIG. 10 to FIG. 14.

Figure 12:
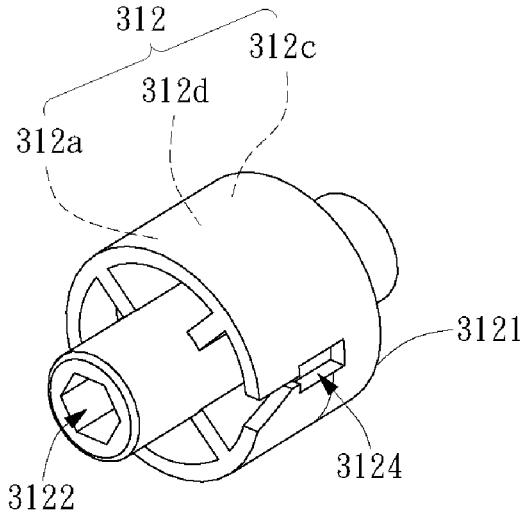
FIG. 12 is a perspective view of the first rotating drum of FIG. 11.
Figure 13:
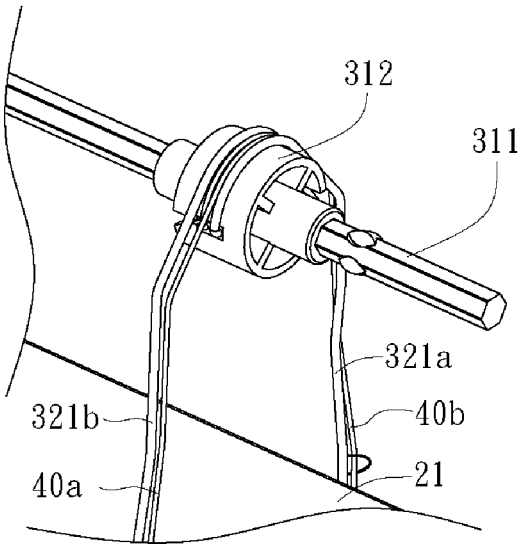
FIG. 13 is a perspective view of FIG. 11 seen from another angle.
Figure 14:
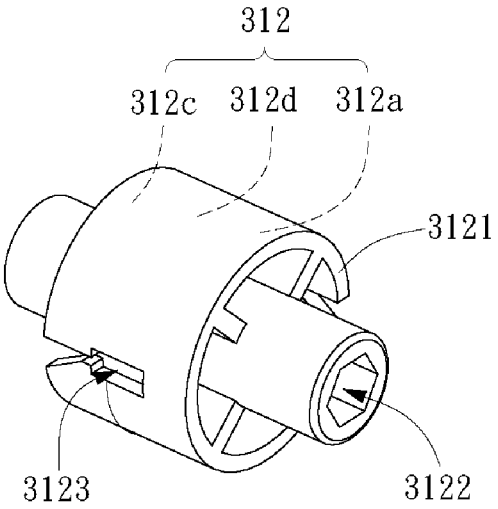
FIG. 14 is a perspective view of the first rotating drum of FIG. 13.

The structure of the first rotating drum 312 of the current embodiment is specifically explained below: said first rotating drum 312 has a first tube body 3121 and a first axial passage 3122, wherein the first axial passage 3122 goes through the first tube body 3121 to be passed through by the rotating shaft 311. A shape of a cross-section of the first axial passage 3122 is non-circular, and said shape matches the shape and size of the cross-section of the rotating shaft 311, so that the rotation of the rotating shaft 311 could drive the first rotating drum 312 to rotate synchronously. Furthermore, the first tube body 3121 has a first engaging slot 3123 and a second engaging slot 3124 provided thereon in a direction roughly parallel to the longitudinal axis 11. Said first engaging slot 3123 and said second engaging slot 3124 are respectively located on opposite sides of the first tube body 3121. The first engaging slot 3123 and the second engaging slot 3124 are both narrow slots having an open end and a closed end. The open end of the first engaging slot 3123 is at an end of the first tube body 3121, and the open end of the second engaging slot 3124 is at another end of the first tube body 3121, as shown in FIG. 12 and FIG. 14. A top end of the front warp 321*a* of the ladder 321 can be securely engaged in the first engaging slot 3123 through a stop member 321*e*, and top ends of the rear warp 321*b* and the first cord 40*a* can be securely engaged in the second engaging slot 3124 through another stop member 321*e*. It would be understandable that, though the stop members 321*e* in the current embodiment are clips, this is not a limitation of the present disclosure. In other embodiments, the stop members for the first cord 40*a* or the front warp 321*a* and the rear warp 321*b* of the ladder 321 can be knots formed by themselves, or other structures or parts capable of engaging the top end of the first cord 40*a* and the top ends of the warps 321*a*, 321*b* of the ladder 321 into the first and second engaging slots 3123, 3124. Further, though the first engaging slot 3123 and the second engaging slot 3124 in the current embodiment are narrow slots having an open end and a closed end located at opposite ends of the first tube body 3121, this is not a limitation of the present disclosure, either. In other embodiments, the first engaging slot 3123 and the second engaging slot 3124 can be holes or slots with two open ends; the open ends of engaging slots can also be at the same end of the first tube body 3121 instead.

As shown in FIG. 3 to FIG. 8, in the current embodiment, the cord assembly 40 can further include a third cord 40*c* and a fourth cord 40*d*. The second cord 40*b* is provided corresponding to the first cord 40*a*, and is located on the front side of the slats 21 of the slat assembly 20. The third cord 40*c* and the fourth cord 40*d* are close to the ladder 322 and are respectively located on the front and rear sides of the slats 21 of the slat assembly 20, as shown in FIG. 3. The top end of the second cord 40*b* is engaged in the first engaging slot 3123 of the first rotating drum 312 along with the front warp 321*a* of the ladder 321, as shown in FIG. 10 to FIG. 14. Similarly, as shown in FIG. 2 and FIG. 3, the third cord 40*c* and the fourth cord 40*d* are engaged in a second rotating drum 313 along with the rear warp 322*b* and the front warp 322*a* of the ladder 322, respectively. In the current embodiment, the first rotating drum 312 is, but not limited to, integrally composed of the first rotating member 312*a*, the third rotating member 312*c*, and the fourth rotating member 312*d*, which means the rear warp 321*b* and the front warp 321*a* of the ladder 321, the first cord 40*a*, and the second cord 40*b* are all connected onto one single first rotating drum 312, as shown in FIG. 2 and FIG. 11 to FIG. 14.

After some design, said cords 40*b*, 40*c*, 40*d* could collaborate with the corresponding ladders 321, 322 to restrict the slats from lateral movements, as the first cord 40*a* mentioned above does, and could be used as lifting cords to raise and lower the slat assembly 20. If each of the cords 40*a*, 40*b*, 40*c*, 40*d* is used as a lifting cord to raise and lower the slat assembly 20, then the window blind of the current embodiment could further include a lifting device 50 provided at the bottom end portion 22 of the slat assembly 20, as in the current embodiment, wherein bottom ends of the first cord 40*a*, the second cord 40*b*, the third cord 40*c*, and the fourth cord 40*d* are respectively connected to said lifting device 50. Specifically, the lifting device 50 of the current embodiment includes a power assembly 51 and a cord reeling assembly 52, wherein the power assembly 51 includes a driving wheel 511, a spring receiving spool 512, and a spiral torsion spring 513. The driving wheel 511 and the spring receiving spool 512 are parallel to and spaced apart from each other. Two ends of the spiral torsion spring 513 are respectively connected to the driving wheel 511 and the spring receiving spool 512, and the spiral torsion spring 513 winds around the driving wheel 511 and the spring receiving spool 512 in an S-shaped manner. The cord reeling assembly 52 includes two cord reels 521, 522. In the current embodiment, the bottom ends of the first cord 40*a* and the second cord 40*b* are wound around the cord reel 521, while the bottom ends of the third cord 40*c* and the fourth cord 40*d* are wound around the cord reel 522. Each of the driving wheel 511, the cord reel 521 and the cord reel 522 has a toothed disk which can mesh with one another, so that the driving wheel 511, the cord reel 521, and the cord reel 522 could be driven to be moved concurrently by each other.

Figure 7:
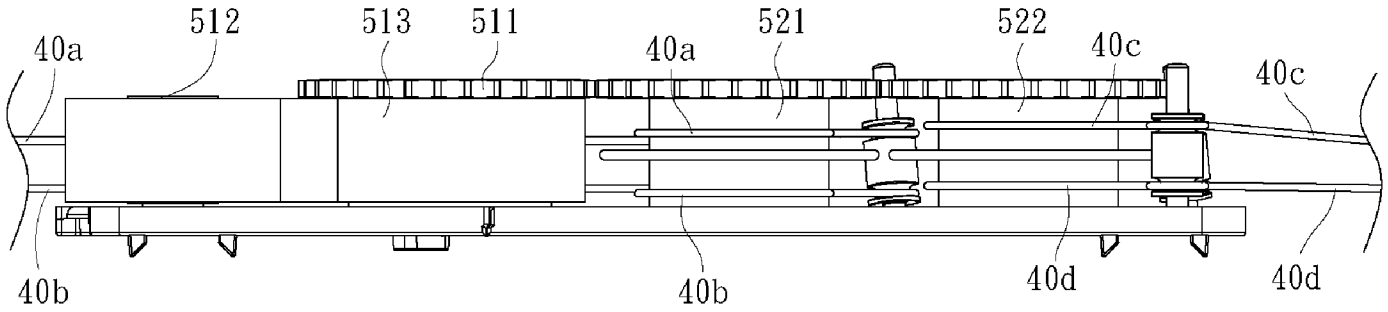
FIG. 7 is a partial schematic view of the lifting device when the slat assembly shown in FIG. 1 is fully expanded.
Figure 8:
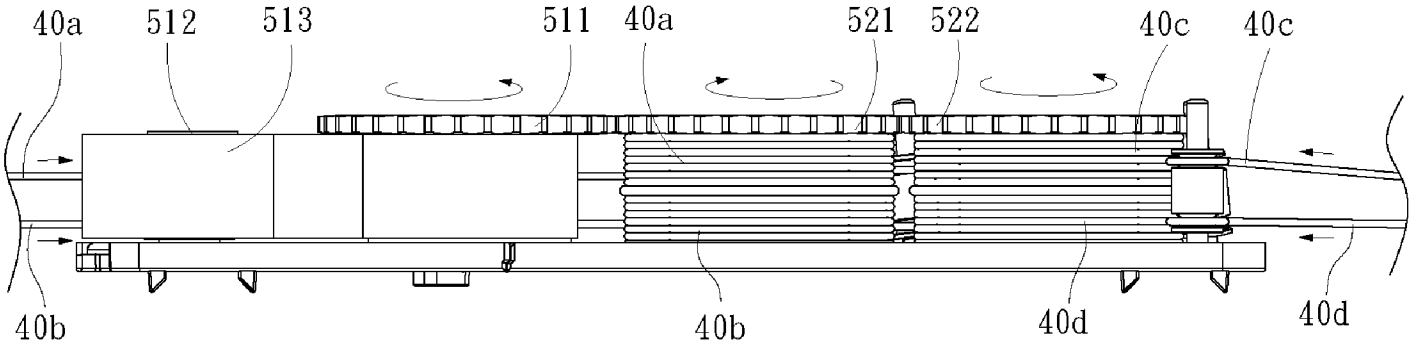
FIG. 8 is a partial schematic view of the lifting device when the slat assembly shown in FIG. 6 is fully collapsed.

When the window blind is, as shown in FIG. 1, fully expanded in the direction parallel to the vertical axis 13, most part of the spiral torsion spring 513 is wound around the driving wheel 511 to accumulate energy. During the expansion of the slat assembly 20 (i.e., while the bottom end portion 22 is moving downward), the driving wheel 511, through the toothed disks, drives each of the cord reels 521, 522 to respectively rotate in a direction of its own, so that most of the first cord 40*a* and the second cord 40*b* are released from the cord reel 521, and most of the third cord 40*c* and the fourth cord 40*d* are released from the cord reel 522 as well (as shown in FIG. 7). While the bottom end portion 22 is being pushed upward in a direction parallel to the vertical axis 13 to gather the slat assembly 20 toward the state shown in FIG. 6, the spiral torsion spring 513 which is originally wound around the driving wheel 511 gradually winds around the spring receiving spool 512 instead, whereby to release the stored energy. At the same time, the reversely rotating driving wheel 511 drives each of the cord reels 521, 522 to rotate respectively in a direction opposite to the direction in which it rotates when the slat assembly 20 is being expanded, whereby the first cord 40*a*, the second cord 40*b*, the third cord 40*c*, and the fourth cord 40*d* are respectively wound around the corresponding cord reels 521, 522, as shown in FIG. 8. However, the arrangement of the lifting device 50 is conventional, and is not limited to the implementation disclosed in the current embodiment; for different requirements, there could be more or fewer components included in the power assembly 51 and in the cord reeling assembly 52. Any mechanisms provided in the bottom end portion 22 capable of reeling in or out the cords along with the raising or lowering of the bottom end portion 22 should be considered equivalent techniques.

More importantly, though the current embodiment discloses the first cord 40*a*, the second cord 40*b*, the third cord 40*c*, and the fourth cord 40*d* at once, this is merely for exemplifying purposes, and not a limitation. With respect to carrying out the objective of the present disclosure, not all of the cords are mandatory. For example, to achieve the objective of restricting the slats 21 from lateral movements and providing the function of lifting and lowering the bottom end portion 22, merely having a first cord 40*a* collaborating with the lifting device 50 would be simply sufficient. When taking into consideration the capability of the bottom end portion 22, which should be able to remain stable during motion and allow its turning angle to be adjusted while the tile angle of the slats 21 is being adjusted, either the second cord 40*b* or the fourth cord 40*d* could be further provided to collaborate with the first cord 40*a*, which means, in such circumstances, there could be two cords provided on opposite sides of the slat assembly 20, one in front and the other one in the rear, but said two cords do not always have to be provided at corresponding locations. Either way, the bottom end portion 22 could be ensured not to lean forward or backward. Furthermore, in an implementation that has only one single cord, e.g., the cord assembly 40 only has the first cord 40*a* near the ladder 321, the top ends of the first cord 40*a* and the ladder 321 could be both connected to the integrally formed first rotating drum 312. In such a case, the first rotating drum 312 is composed of, by definition, the first rotating member 312*a* and the third rotating member 312*c* (not shown). Moreover, in an implementation with two corresponding cords which are both near the ladder 321 (fox example, when the cord assembly 40 is composed of the first cord 40*a* and the second cord 40*b* only), the top ends of the first cord 40*a*, the second cord 40*b*, and the ladder 321 could be all connected to the integrally formed first rotating drum 312, wherein the first rotating drum 312 in such a scenario is, by definition, composed of the first rotating member 312*a*, the third rotating member 312*c*, and the fourth rotating member 312*d*, as shown in FIG. 11 to FIG. 14. In yet another example, the cord assembly 40 is also composed of the first cord 40*a* and the second cord 40*b*, but this time, only the first cord 40*a* is near the ladder 321; the second cord 40*b* is near the ladder 322 like the fourth cord 40*d* in FIG. 2. In such an implementation, the top ends of the first cord 40*a* and the ladder 321 could be both connected to the first rotating drum 312, and the top ends of the second cord 40*b* and the ladder 322 could be both connected to the second rotating drum 313. In this case, the first rotating drum 312 is, by definition, composed of the first rotating member 312*a* and the third rotating member 312*c*, and the second rotating drum 313 is, by definition, composed of the second rotating member 312*b* and the fourth rotating member 312*d* (not shown). In addition, the first rotating drum 312 and the second rotating drum 313 in the current embodiment both fit around the rotating shaft 311, with which sharing the same axis. However, this is not a limitation of the present disclosure. Each of the rotating members 312*a*, 312*b*, 312*c*, 312*d* or each of the rotating drums 312, 313 could be provided at another position which is non-coaxial with the rotating shaft 311, as long as it could be concurrently moved along with the rotating shaft 311.

Figure 9:
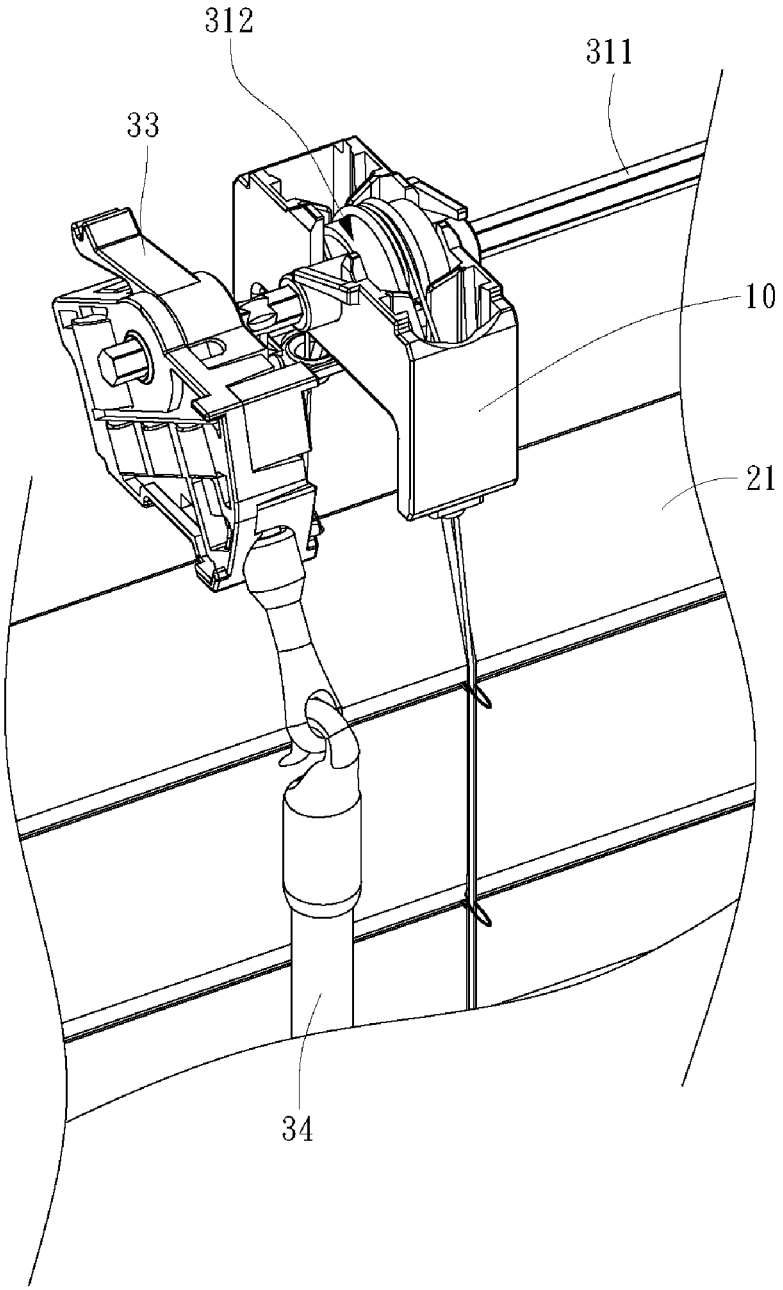
FIG. 9 is a partial schematic view, showing part of the slat angle adjusting device.

Herein we are going to describe the operating relationships between the components of the window blind of the present disclosure when the slats are closed. As shown in FIG. 2 and FIG. 9, the direction-changing mechanism 33 is connected to the rotating shaft 311, wherein the control member 34 is a long rod in the current embodiment, of which an end is connected to the direction-changing mechanism 33, and another end extends out of the housing 10 for users' operation. The structural arrangements of the direction-changing mechanism 33 are conventional and not a claimed subject matter of the present disclosure, and therefore we are not going to describe them in detail. However, it would be understandable that since the direction-changing mechanism 33 is an ordinary component used to rotate the rotating shaft 311 by being driven through the control member 34, all kinds of direction-changing mechanisms in currently known techniques should be considered equivalent. In addition, the control member 34 used to drive the direction-changing mechanism 33 is not limited to be the long rod exemplified in the current embodiment, but could be a rope, a string, or a motor in other embodiments, as long as it could be an operating means for users to drive the direction-changing mechanism 33 to rotate the rotating shaft 311.

Take the left side of FIG. 1 as an example. After the window blind is installed onto a window frame or a wall (not shown) through certain installation members 60, the window blind can be arranged in a manner that the window blind is naturally hung down and the slat assembly 20 is fully expanded, wherein the slats 21 are arranged in a horizontal state shown in FIG. 1 and FIG. 10. At this time, lengths of segments of the front warp 321*a* and the rear warp 321*b* of the ladder 321 received in the housing 10 are roughly the same, and the wefts 321*c* are substantially parallel to a direction of the lateral axis 12.

Figure 15:
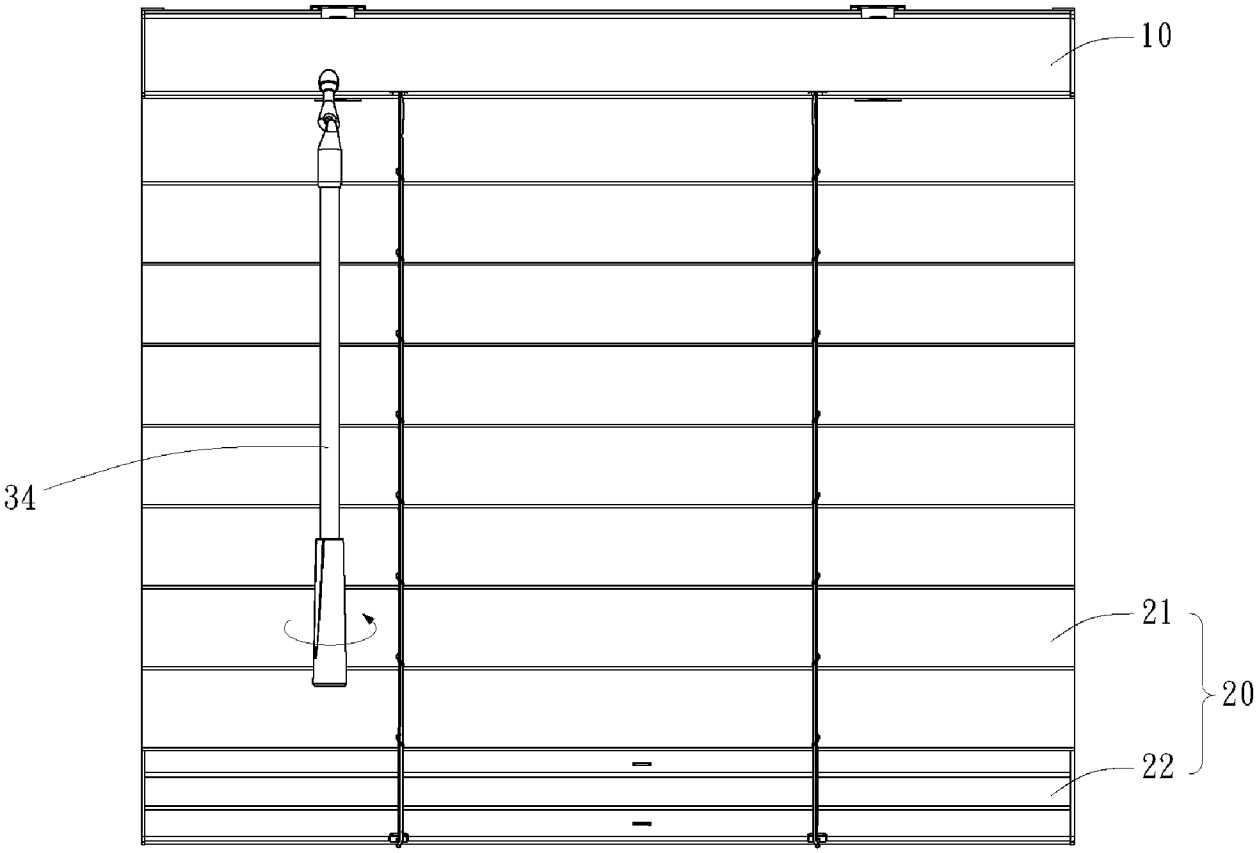
FIG. 15 is a front view of the window blind of the first embodiment of the present disclosure, showing the condition that the slats of the slat assembly are fully closed in a manner that the rear side of each slat is higher than the front side thereof.
Figure 16:
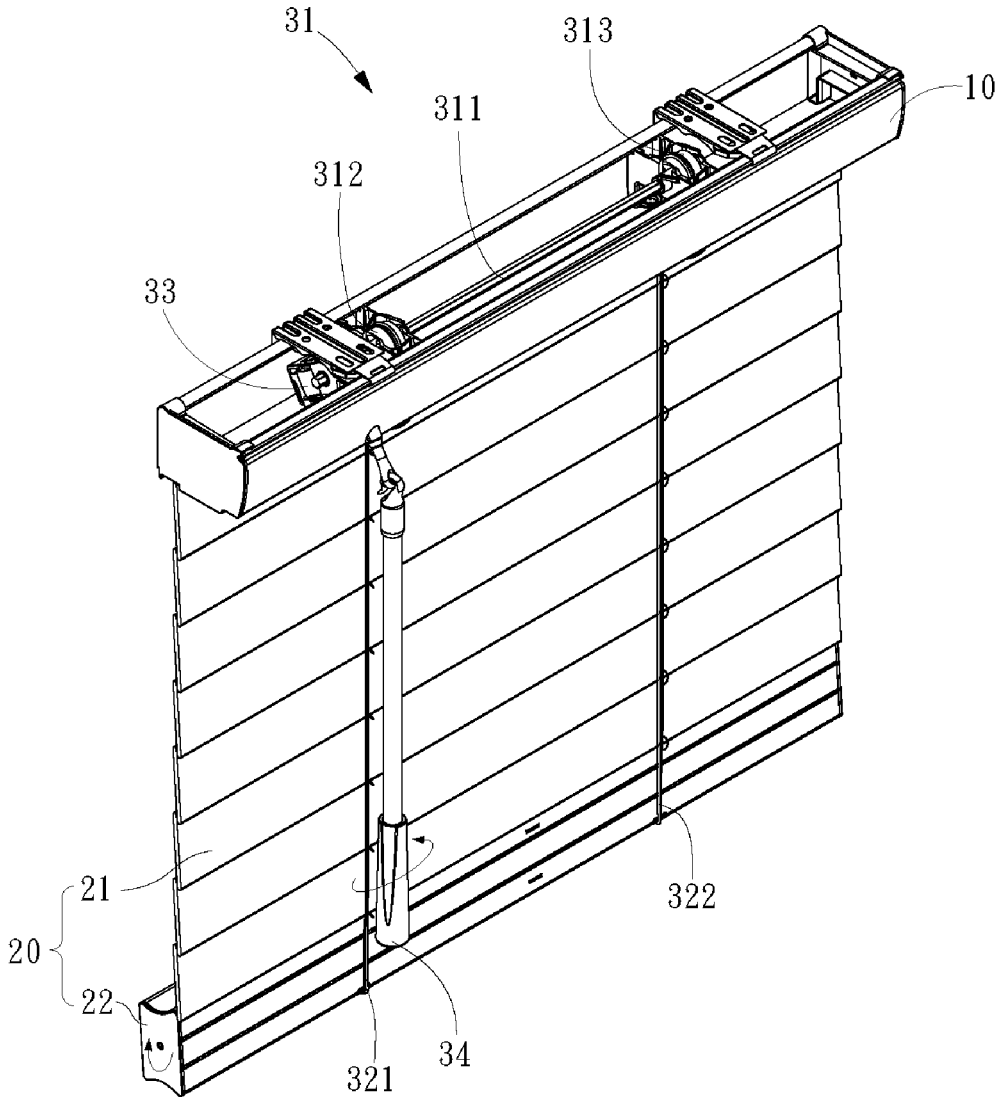
FIG. 16 is a perspective view of FIG. 15 seen from a different angle, also showing the window blind in the condition that the slats of the slat assembly are fully closed with their rear side higher than their front side.
Figure 17:
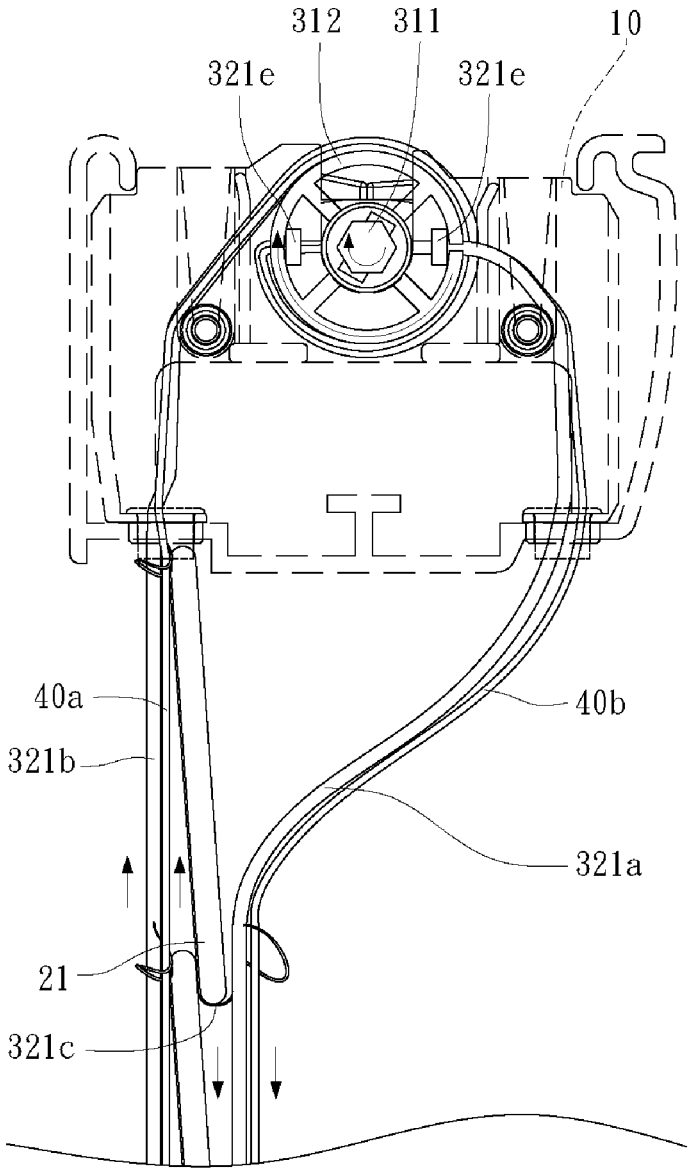
FIG. 17 is a left side view showing part of FIG. 15.

When the control member 34 is maneuvered to rotate in a direction indicated by the arrows shown in FIG. 15 and FIG. 16, it would drive the rotating shaft 311 to rotate the first rotating drum 312. In the current embodiment, the rotation direction of the rotating shaft 311 and the first rotating drum 312 is clockwise in this situation if seen from the angle shown in FIG. 17. Since the shapes of the rotating shaft 311 and the first axial passage 3122 of the first rotating drum 312 match each other, the clockwise rotation of the rotating shaft 311 could drive the first rotating drum 312 to rotate during the whole process in a manner that the rear warp 321*b* of the ladder 321 and the first cord 40*a* are moved upward, and the front warp 321*a* and the second cord 40*b* are moved downward. As a result, the slats 21 and the bottom end portion 22 would be gradually rotated with their front side going down and rear side going up. Whereby, even though the lengths of the first cord 40*a* and the second cord 40*b* released from the lifting device 50 remain unchanged during the rotation of the rotating shaft 311, the first cord 40*a* and the second cord 40*b* could still create a relative vertical movement throughout the rotation of the rotating shaft 311, as the front warp 321*a* and the rear warp 321*b* do. Therefore, the first cord 40*a* and the second cord 40*b* could help the bottom end portion 22 to rotate together, all the way along with the rotation of the rotating shaft 311. As a result, the bottom end portion 22 would have the same turning angle as the slats (as shown in FIG. 16), regardless of the fact that the lengths of the first cord 40*a* and the second cord 40*b* are fixed.

Figure 18:
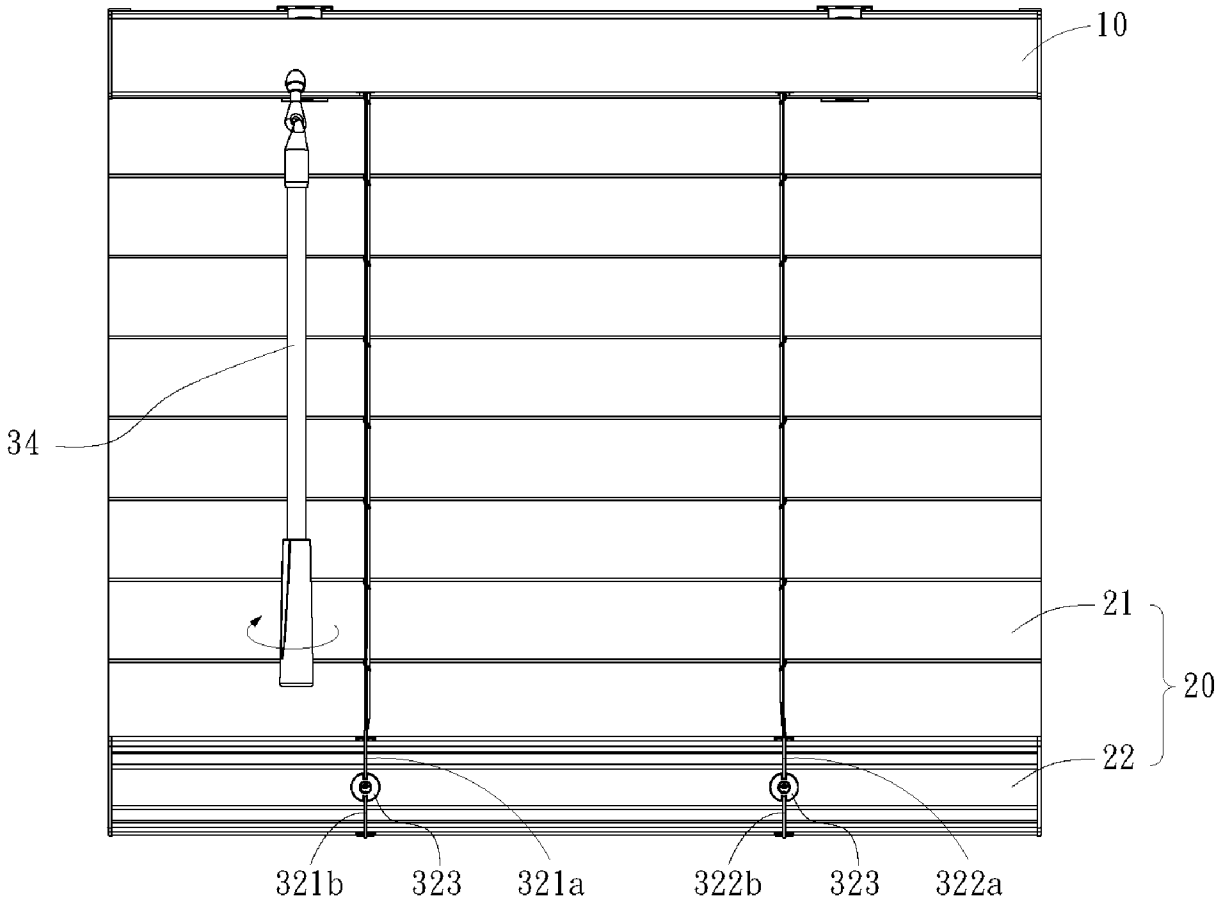
FIG. 18 is a front view of the window blind of the first embodiment of the present disclosure, showing the condition that the slats of the slat assembly are fully closed in a manner that the front side of each slat is higher than the rear side thereof.
Figure 19:
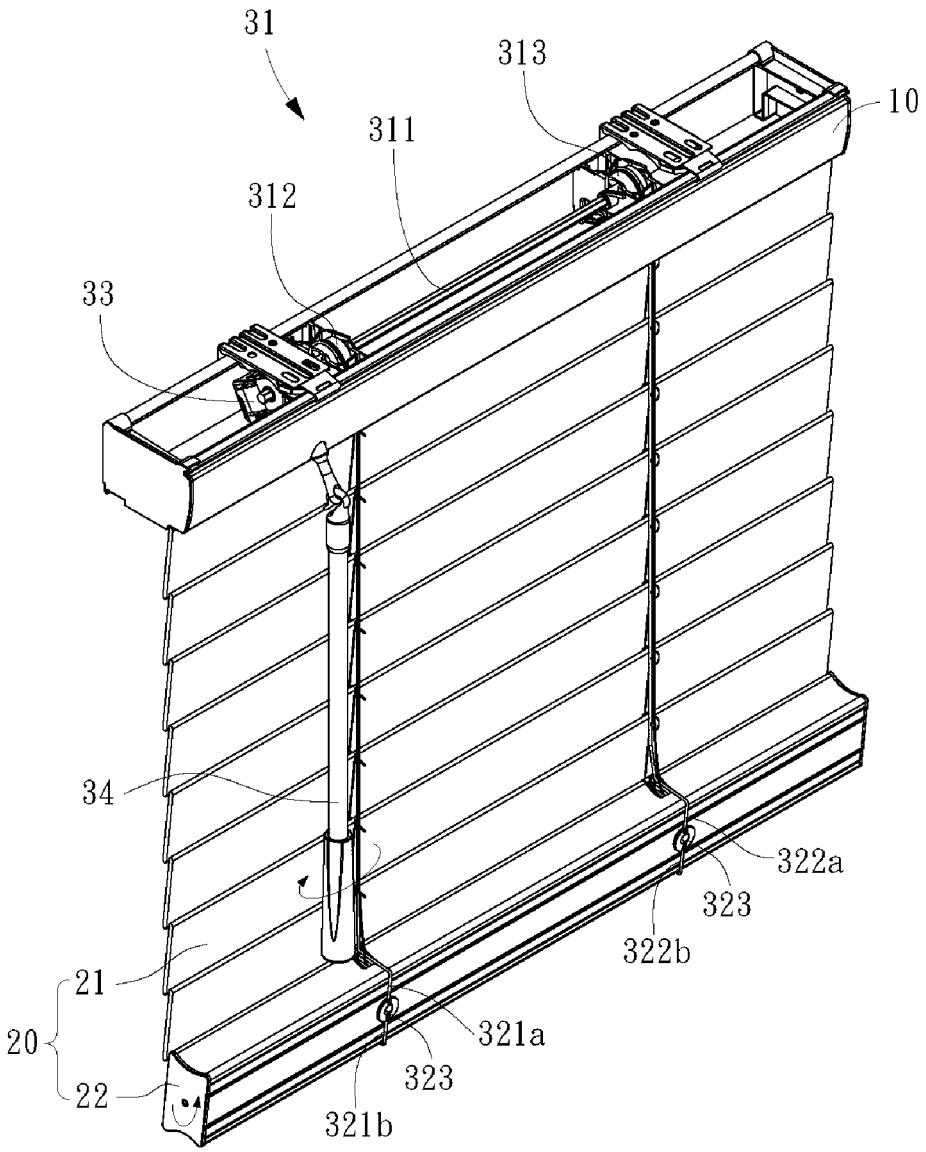
FIG. 19 is a perspective view of FIG. 18 seen from a different angle, also showing the window blind in the condition that the slats of the slat assembly are fully closed with their front side higher than their rear side.
Figure 20:
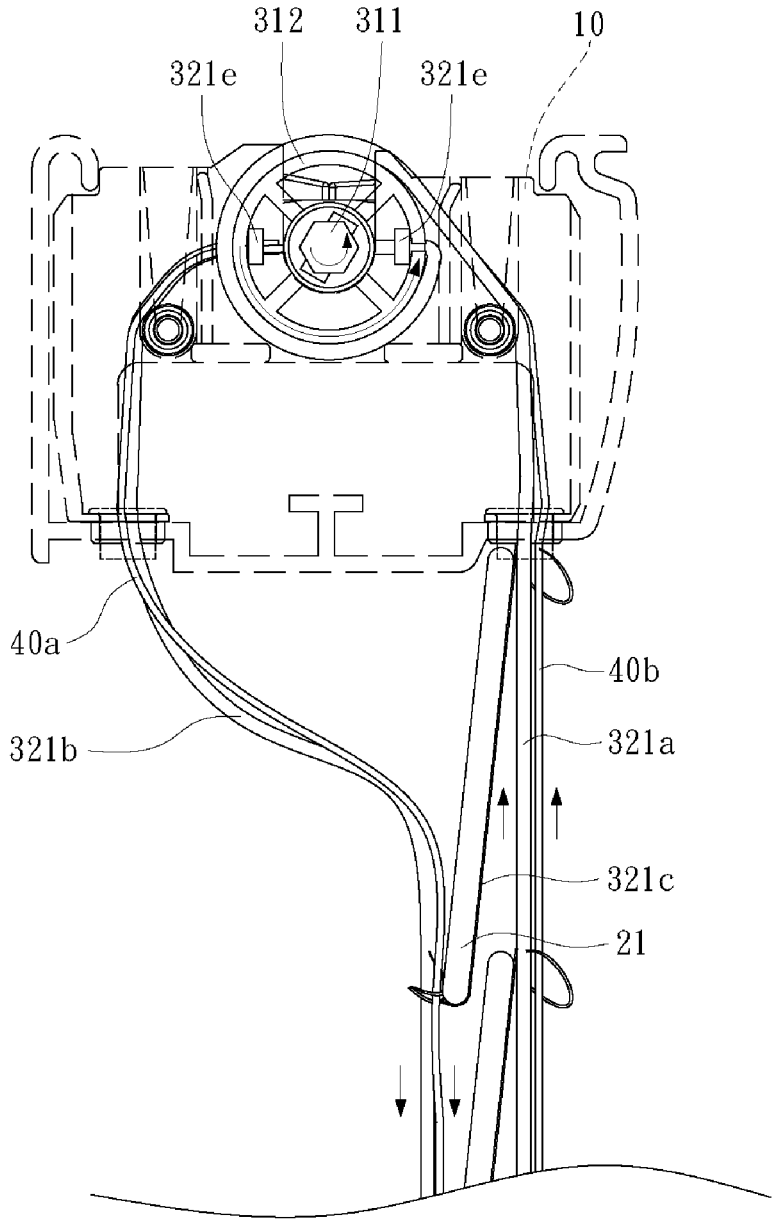
FIG. 20 is a left side view showing part of FIG. 18.

When the control member 34 is maneuvered to rotate in another direction indicated by the arrows shown in FIG. 18 and FIG. 19, the rotating shaft 311 and the first rotating drum 312 would be rotated counterclockwise, as seen in FIG. 20. Similarly, the counterclockwise rotation of the rotating shaft 311 could drive the first rotating drum 312 to rotate all the way together, and could also simultaneously drive the rear warp 321*b* and the front warp 321*a* of the ladder 321, the first cord 40*a*, and the second cord 40*b* to move in a manner that the rear warp 321*b* and the first cord 40*a* are moved downward, and the front warp 321*a* and the second cord 40*b* are moved upward. Whereby the slats 21 and the bottom end portion 22 could gradually rotate together in a way that their front side goes upward and rear side goes downward. Furthermore, similar to what mentioned above, the first cord 40*a* and the second cord 40*b* could have a relative vertical movement throughout the rotation of the rotating shaft 311, just like the rear warp 321*b* and the front warp 321*a*. In this way, the bottom end portion 22 could have the same turning angle with the slats 21, as shown in FIG. 19.

Figure 21:
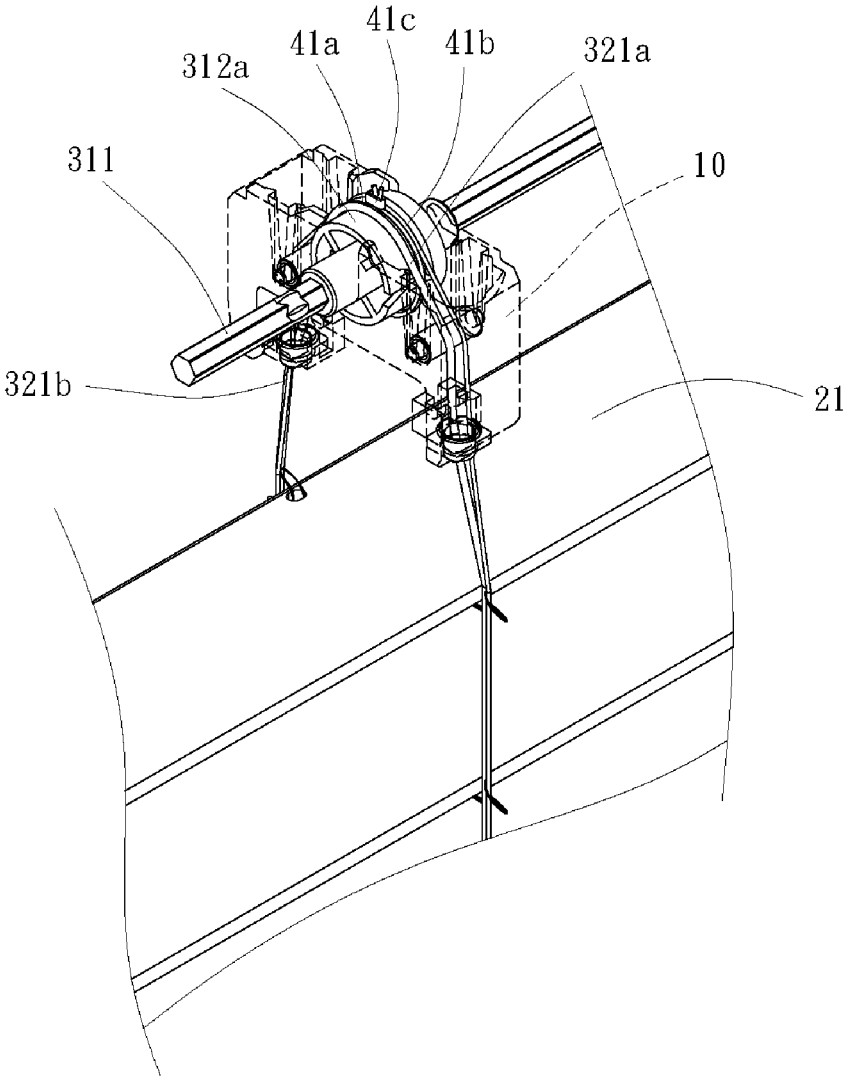
FIG. 21 is a partial schematic view of the window blind of a second embodiment of the present disclosure, showing the arrangement of the rotating shaft assembly when the slat assembly is fully expanded and the slats are horizontally arranged.

A window blind of a second embodiment of the present disclosure can be seen in FIG. 21 to FIG. 24, of which first and second cords have different arrangements from the first embodiment. The current embodiment has basically the same structures with the first embodiment. More specifically, it also includes a housing 10, a slat assembly 20, a slat angle adjusting device 30, and a cord assembly 40. Moreover, the window blind of the current embodiment also has a first rotating drum 312, and top ends of a front warp 321*a* and a rear warp 321*b* of a ladder 321 are also fixed in a first engaging slot 3123 and a second engaging slot 3124 of the rotating drum 312. Furthermore, the window blind of the current embodiment includes a first cord 41*a* and a second cord 41*b* as well, which are also correspondingly provided on rear and front sides of slats 21, respectively, as the rear warp 321*b* and the front warp 321*a* are. The current embodiment is different from the above-mentioned embodiment in that the top end of the first cord 41*a* and the top end of the second cord 41*b* are connected through a jointing member 41*c*. When the first cord 41*a* and the second cord 41*b* are both fully released, segments of the first cord 41*a* and the second cord 41*b* near the top ends thereof curve along a cylindrical surface of the first rotating drum 312. Since bottom ends of the first cord 41*a* and the second cord 41*b* are connected to the bottom end portion 22 of the slat assembly 20, the first cord 41*a* and the second cord 41*b* would at least have to have the capability to withstand a downward pulling force exerted by the weight of the bottom end portion 22. While the slat assembly 20 is being retracted upward, said pulling force would become greater as more slats 21 are stacked on the bottom end portion 22. Therefore, the first cord 41*a* and the second cord 41*b* wound around the first rotating drum 312 would roughly run along the cylindrical surface of the first tube body 3121. With more rounds of the cords or greater downward pulling force, the first cord 41*a* and the second cord 41*b* would be less likely to move relative to the first rotating drum 312, and therefore could be deemed fixed onto the first tube body 3121 of the first rotating drum 312. In effect, such arrangement would be similar to that of the first cord 40*a* and the second cord 40*b* in the previous embodiment, of which the top ends are directly fixed in the first engaging slot 3213 and the second engaging slot 3214 of the first rotating drum 312. Similarly, if top ends of the front warp 321*a* and the rear warp 321*b* of the ladder 321 are connected and wound around the first tube body 3121 of the first rotating drum 312, such arrangement would be able to provide a similar effect as the first embodiment, in which the top ends of the front warp 321*a* and the rear warp 321*b* are secured in the first engaging slot 3213 and the second engaging slot 3214. Understandably, the jointing member 41*c* could be a clip as shown in FIG. 21, or could be a knot formed by tying the first cord 41*a* and the second cord 41*b*. In another embodiment, the first cord 41*a* and the second cord 41*b* could be two different segments of one single cord: one in the front and the other one in the rear of the slats 21.

Figure 22:
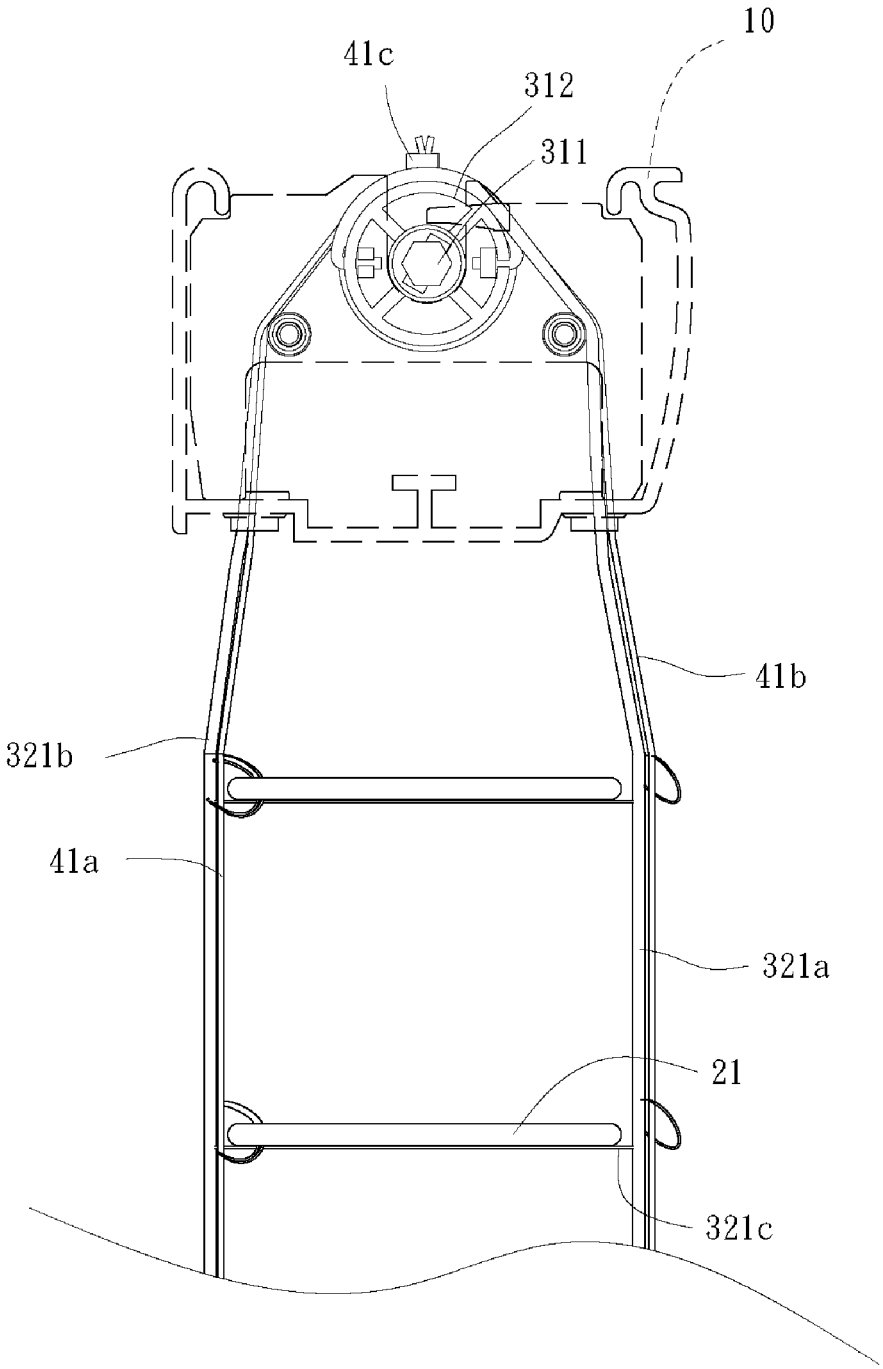
FIG. 22 is a left side view of FIG. 21.
Figure 23:
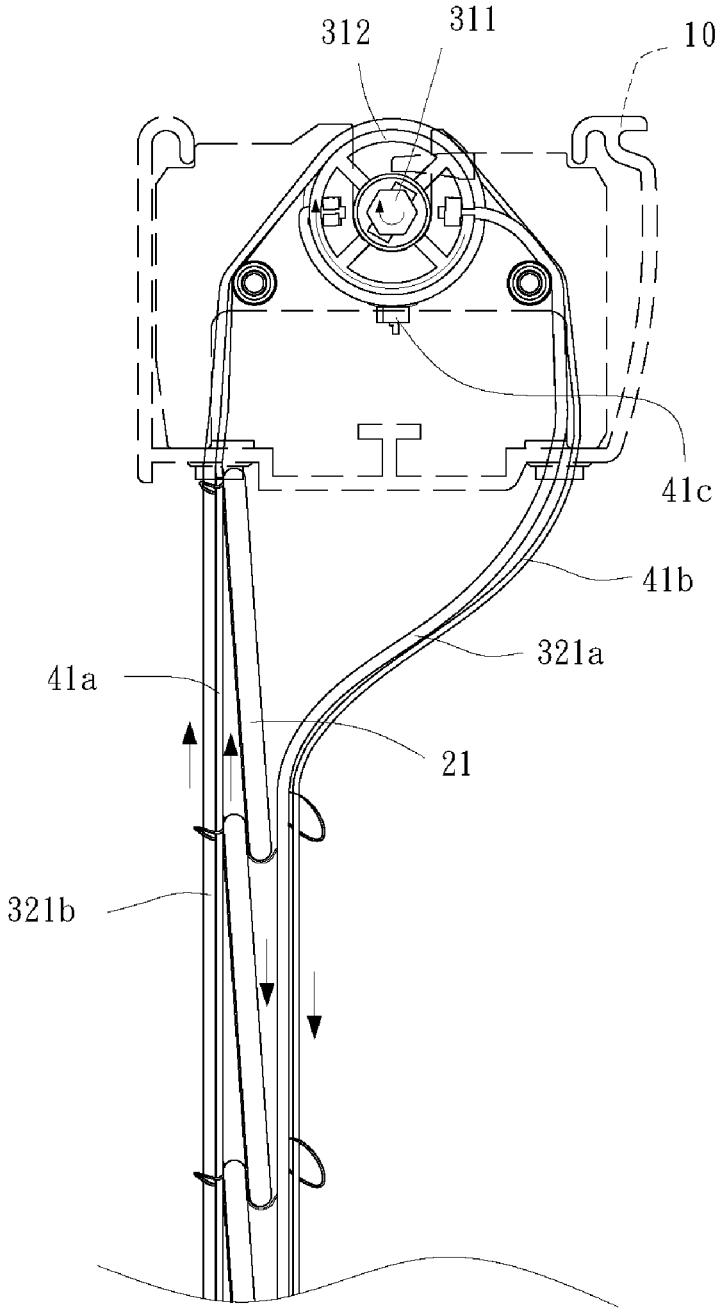
FIG. 23 is a partial left side view of the window blind of the second embodiment of the present disclosure, showing the arrangement of the rotating shaft assembly when the slats of the slat assembly are fully closed in a manner that the rear side of each slat is higher than the front side thereof.

As shown in FIG. 21 and FIG. 22 (with FIG. 1 used as a reference), when the slat assembly 20 is fully expanded and the slats 21 are arranged in a horizontal state which can be seen in FIG. 1 and FIG. 22, lengths of segments of the front warp 321*a* and the rear warp 321*b* of the ladder 321 located inside the housing 10 are roughly the same. As shown in FIG. 23 (with FIG. 16 used as a reference), when the control member 34 is maneuvered to rotate in the direction indicated in FIG. 16, the rotating shaft 311 would drive the first rotating drum 312 to rotate. In the current embodiment, the rotating shaft 311 and the first rotating drum 312 are rotated clockwise in such situation. Furthermore, the rotation of the rotating shaft 311 would take the first rotating drum 312 to rotate together all the way, and would drive the front warp 321*a* and the rear warp 321*b* of the ladder 321, the first cord 41*a*, and the second cord 41*b* at the same time in a manner that the rear warp 321*b* and the first cord 41*a* are moved upward, and the front warp 321*a* and the second cord 41*b* are moved downward. As a result, the slats 21 and the bottom end portion 22 would gradually turn together, with their front side going down and rear side going up, so that the bottom end portion 22 could be rotated throughout the rotation of the rotating shaft 311. Therefore, the bottom end portion 22 could have the same turning angle as the slats 21 without being affected or hindered by the fact that the lengths of the first cord 41*a* and the second cord 41*b* are fixed, and the window blind could eventually reach the state shown in FIG. 16, wherein the slats 21 and the bottom end portion 22 are fully closed in a manner that the rear side thereof is higher than the front side thereof.

Figure 24:
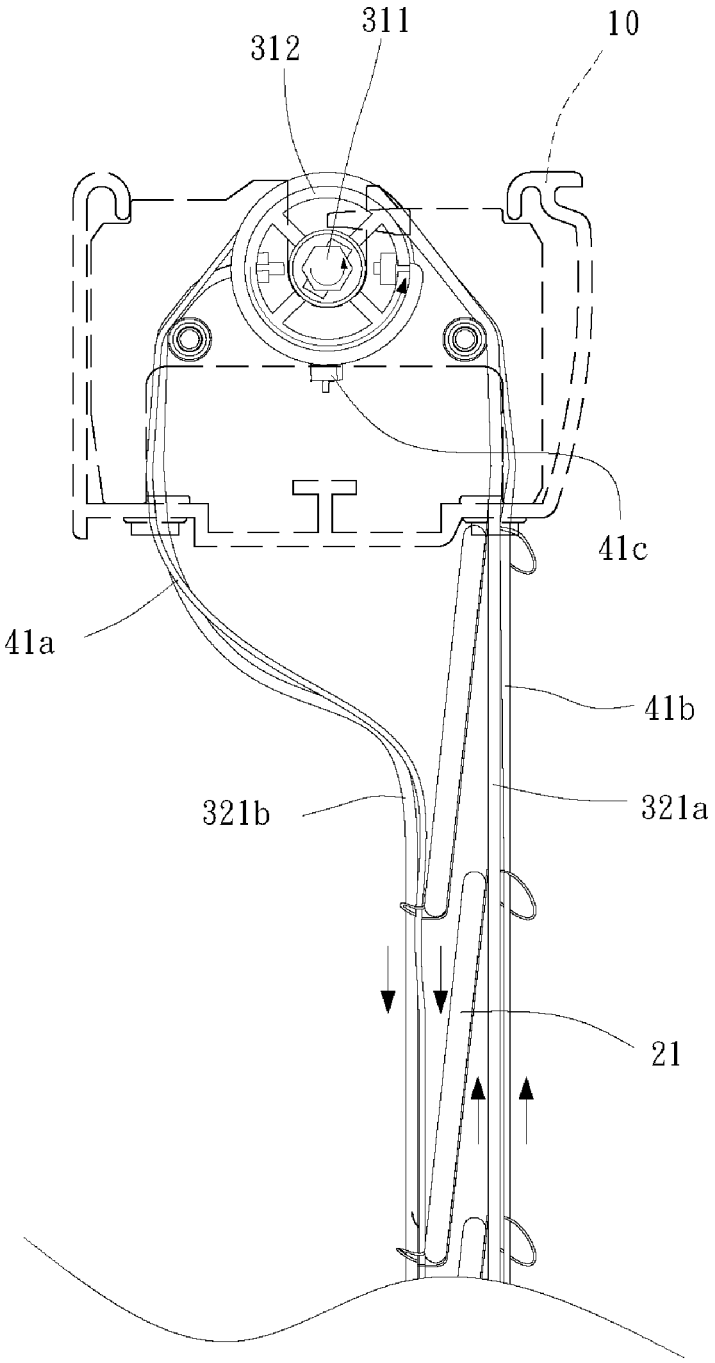
FIG. 24 is a partial left side view of the window blind of the second embodiment of the present disclosure, showing the arrangement of the rotating shaft assembly when the slats of the slat assembly are fully closed in a manner that the front side of each slat is higher than the rear side thereof.

In addition, as shown in FIG. 24 (and with FIG. 19 as a reference), when the control member 34 is operated to rotate in another direction, it drives the rotating shaft 311 and the first rotating drum 312 to rotate counterclockwise. Similarly, the rotation of the rotating shaft 311 would bring the first rotating drum 312 to rotate together all the way, whereby the rear warp 321*b* of the ladder 321 and the first cord 41*a* would be concurrently moved downward, and the front warp 321*a* of the ladder 321 and the second cord 41*b* would be moved upward at the same time. Consequently, the slats 21 and the bottom end portion 22 would be gradually rotated together, with their front side going up and rear side going down. As mentioned above, throughout the rotation of the rotating shaft 311, the first cord 41*a* and the second cord 41*b* would also create a relative vertical movement, just like the rear warp 321*b* and the front warp 321*a*, so that the bottom end portion 22 could have the same turning angle with the slats 21, making the window blind become the fully closed state shown in FIG. 19, wherein the slats 21 and the bottom end portion 22 have their front side higher than their rear side.

Figure 25:
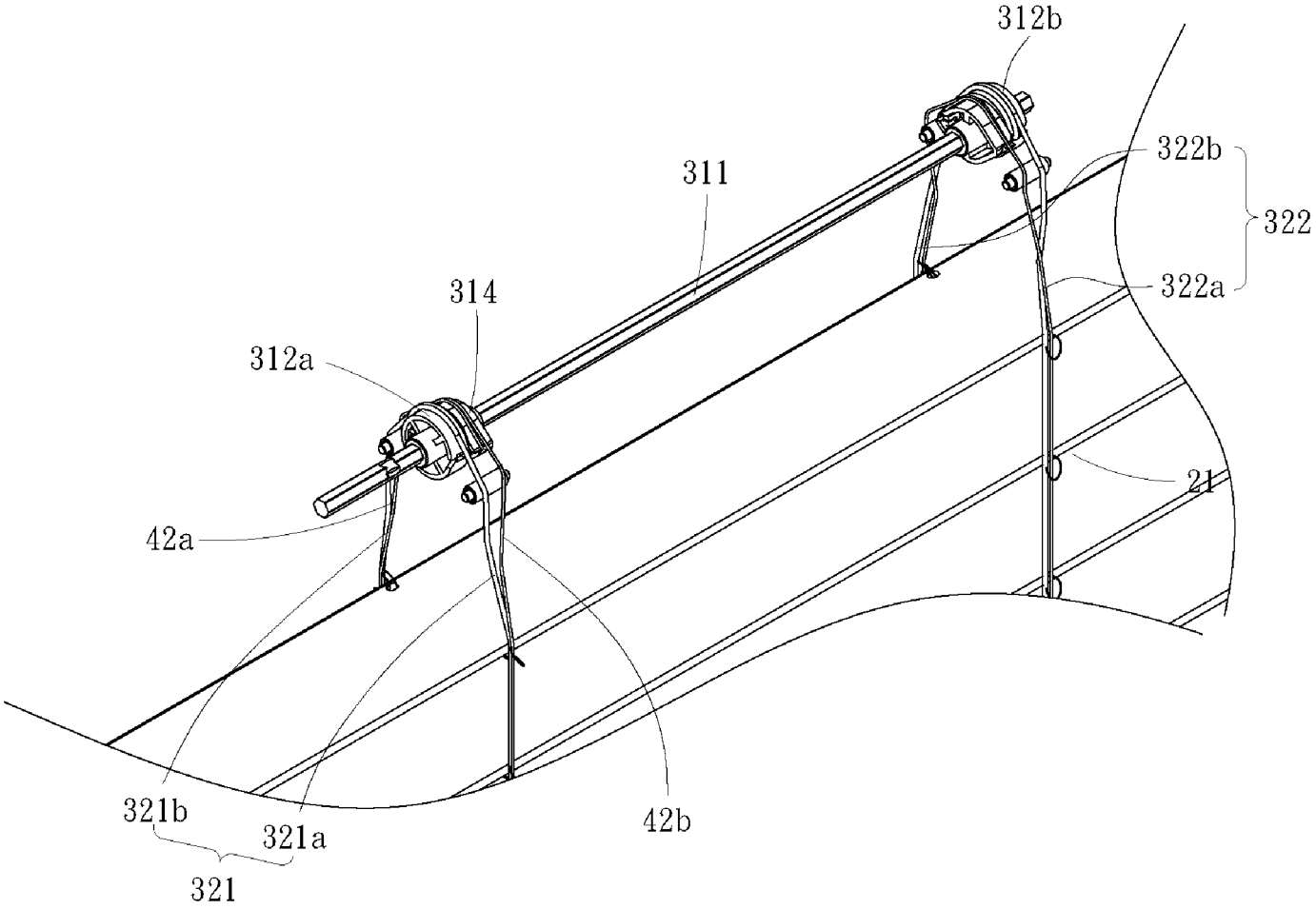
FIG. 25 is a partial perspective view of the window blind of a third embodiment of the present disclosure, showing the arrangement of the rotating shaft assembly of the slat angle adjusting device.
Figure 26:
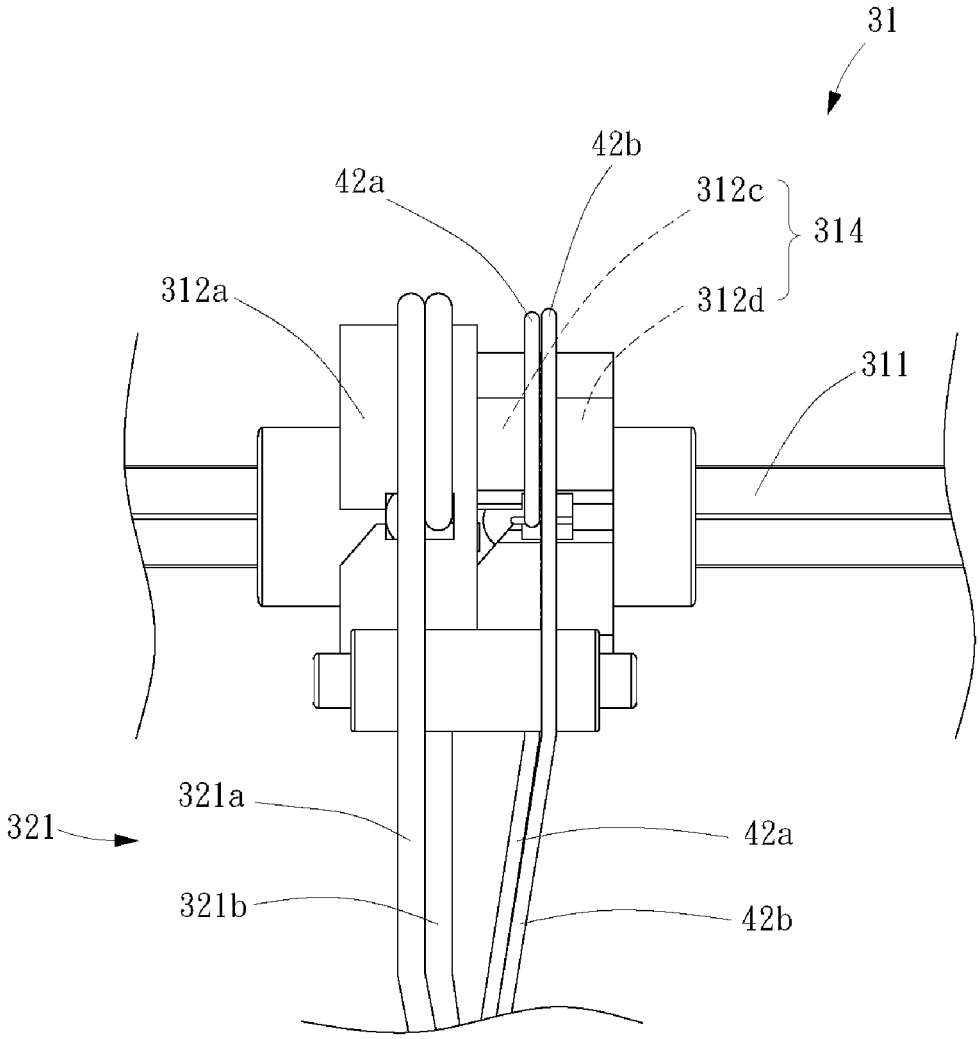
FIG. 26 is a partial front view of FIG. 25, showing the arrangements of the first rotating member and the cord rotating drum.
Figure 27:
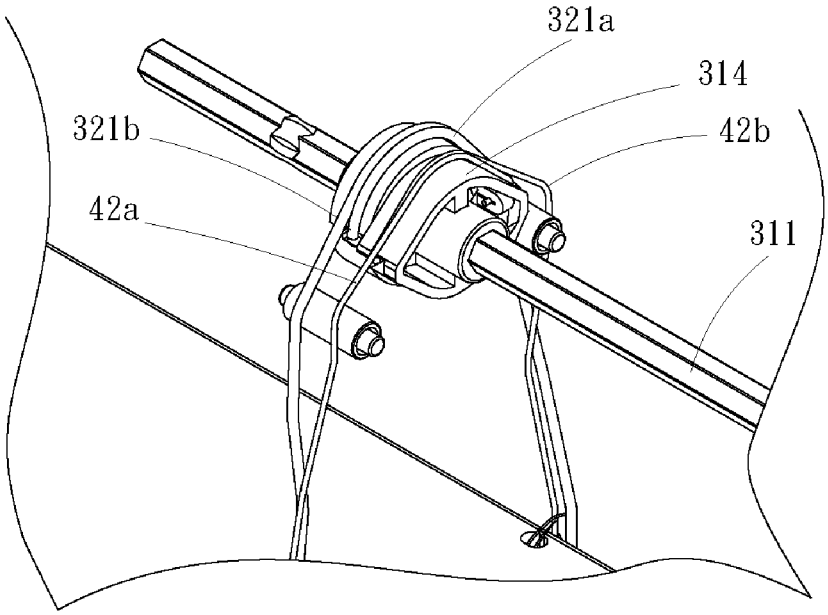
FIG. 27 is a perspective view of FIG. 26 seen from another angle.
Figure 28:
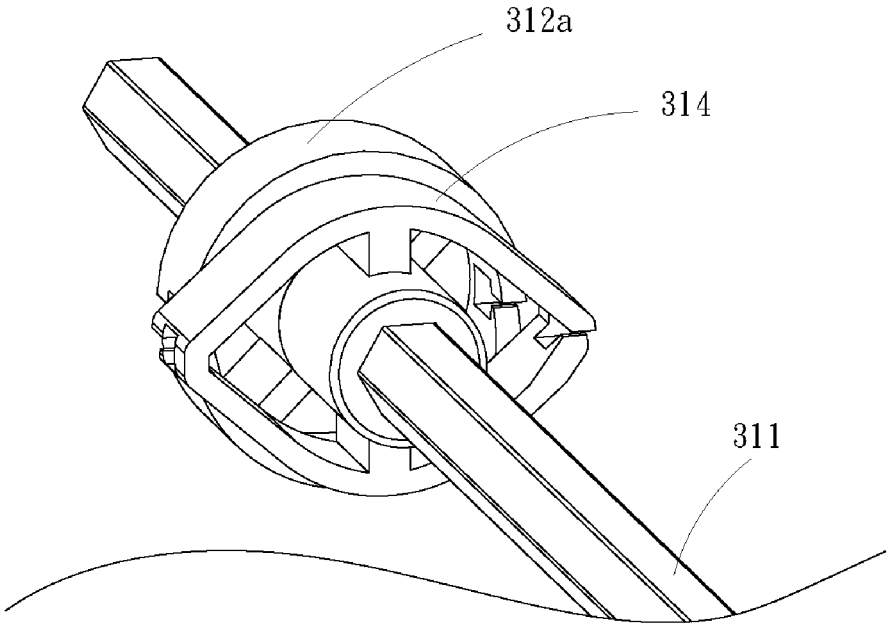
FIG. 28 is a partial schematic view of FIG. 27, showing the arrangements of the first rotating member and the cord rotating drum.

A third embodiment of the present disclosure is shown in FIG. 25 to FIG. 28, which discloses a rotating shaft assembly different from those disclosed in the previous embodiments. FIG. 2 can be used as a reference, for FIG. 25 is seen from an angle similar to FIG. 2. The third embodiment has roughly the same structure as the first embodiment, and also includes a housing 10, a slat assembly 20, a slat angle adjusting device 30, and a cord assembly 40. Furthermore, top ends of a front warp 321*a* and a rear warp 321*b* of a ladder 321 of the ladder assembly 32 are connected to a first rotating member 312*a*, while top ends of a front warp 322*a* and a rear warp 322*b* of another ladder 322 is connected to a second rotating member 312*b*. The first cord 42*a* passes on the rear side of slats 21, and the second cord 42*b* passes on the front side of the slats 21, wherein a top end of the first cord 42*a* is connected to the third rotating member 312*c*, and a top end of the second cord 42*b* is connected to the fourth rotating member 312*d*. In the current embodiment, the third rotating member 312*c* and the fourth rotating member 312*d* are integrally made to form one single cord rotating drum 314.

Figure 29B:
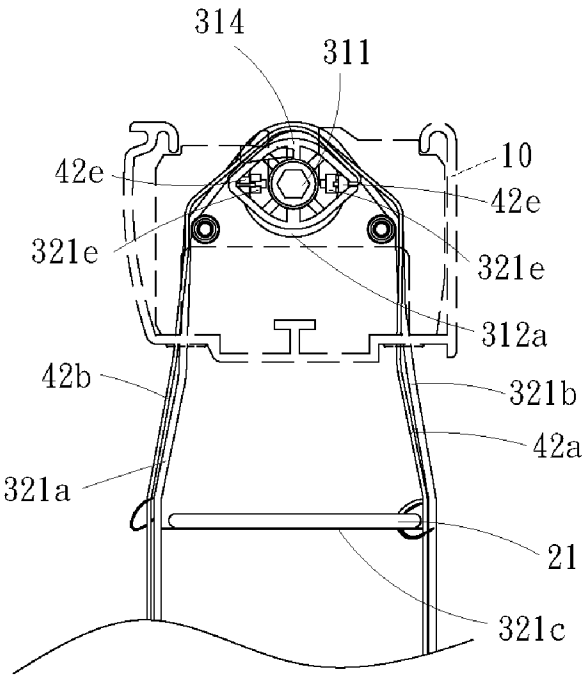
FIG. 29B is a right side view of FIG. 29A.
Figure 29A:
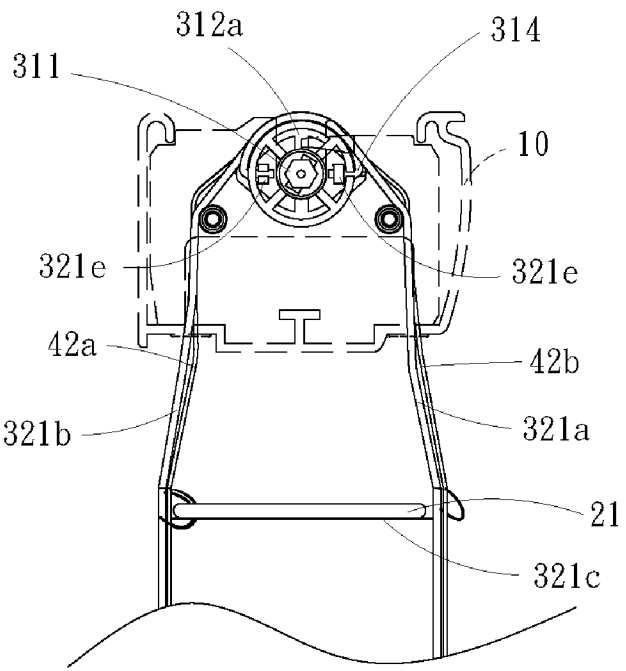
FIG. 29A is a partial left side view of the window blind of the third embodiment of the present disclosure, showing the arrangement of the rotating shaft assembly when the slat assembly is fully expanded and the slats are horizontally arranged.

In the previous embodiments, the disclosed rotating members 312*a*, 312*b*, 312*c*, 312*d* all have a roughly equal perimeter, and the outline of each of the rotating members 312*a*, 312*b*, 312*c*, 312*d* is roughly cylindrical. However, in the current embodiment, the first rotating member 312*a* and the cord rotating drum 314 have different outlines, wherein the first rotating member 312*a* is roughly cylindrical, while the cord rotating drum 314 integrally formed by the third rotating member 312*c* and the fourth rotating member 312*d* is roughly olive-shaped. In addition, the first rotating member 312*a* and the cord rotating drum 314 respectively have engaging slots similar to the first engaging slot 3123 and the second engaging slot 3124 disclosed in the first embodiment (as shown in FIG. 12 and FIG. 14) on opposite sides thereof, wherein said engaging slots are provided to allow the top ends of the front warp 321*a* and the rear warp 321*b* of the ladder 321 and the top ends of the first cord 42*a* and the second cord 42*b* to be engaged therein, respectively. Similar to the embodiments, the top ends of the front warp 321*a* and the rear warp 321*b* of the ladder 321 can be engaged in the engaging slots on two sides of the first rotating member 312*a* through stop members 321*e*, while the top ends of the first cord 42*a* and the second cord 42*b* can be engaged in the engaging slots of the cord rotating drum 314 through stop members 42*e*, as shown in FIG. 29A and FIG. 29B. The related structures are similar to those mentioned above, and therefore we are not going to describe the details herein.

As shown in FIG. 29A and FIG. 29B (and with FIG. 1 used as a reference), when the slat assembly 20 is fully expanded and the slats 21 are arranged in the horizontal state which can be seen in FIG. 1, FIG. 29A, and FIG. 29B, lengths of segments of the front warp 321*a* and the rear warp 321*b* of the ladder 321 located in the housing 10 are roughly the same, and lengths of the first cord 42*a* and the second cord 42*b* are roughly the same, too.

Figure 30B:
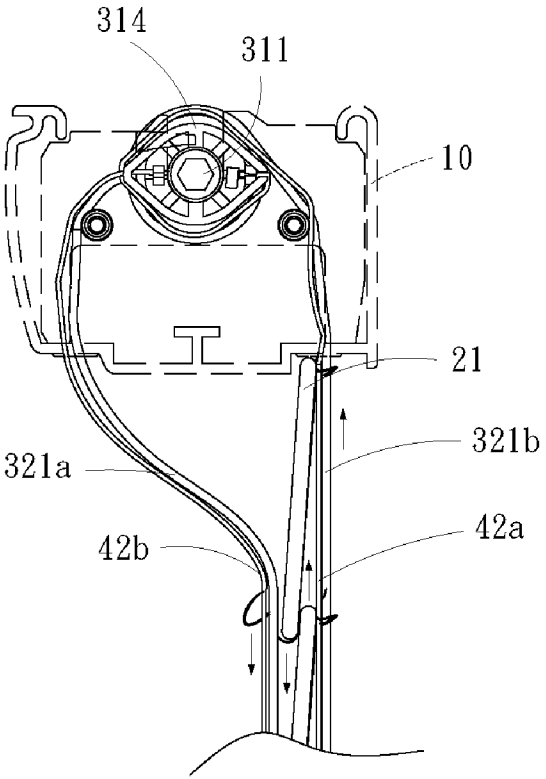
FIG. 30B is a right side view of FIG. 30A.
Figure 30A:
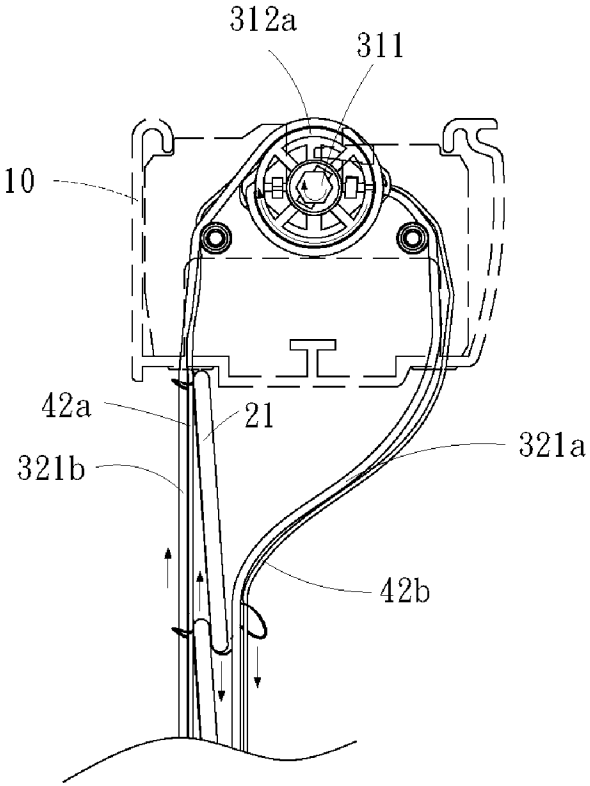
FIG. 30A is a partial left side view of the window blind of the third embodiment of the present disclosure, showing the arrangement of the rotating shaft assembly when the slats of the slat assembly are fully closed in a manner that the rear side of each slat is higher than the front side thereof.

As shown in FIGS. 30A and 30B (and with FIG. 16 used as a reference), when the control member 34 is maneuvered to rotate in the direction indicated in these drawings, the rotating shaft 311 would be driven to rotate the first rotating drum 312. In the current embodiment, the rotation direction of the rotating shaft 311 at this time is clockwise if seen in the left side view FIG. 30A. Furthermore, the rotation of the rotating shaft 311 would drive the first rotating member 312*a* and the cord rotating drum 314 to rotate together all the way, driving the rear warp 321*b* of the ladder 321 and the first cord 42*a* to move upward and driving the front warp 321*a* of the ladder 321 and the second cord 42*b* to move downward at the same time. As a result, the slats 21 and the bottom end portion 22 could be further driven to gradually rotate together, with the front side thereof lower than the rear side thereof. In this way, the bottom end portion 22 could be rotated throughout the rotation of the rotating shaft 311, by which the bottom end portion 22 could have the same tilting angle as the slats without being affected or hindered by the fixed lengths of the first cord 42*a* and the second cord 42*b*, and the window blind would eventually become the state shown in FIG. 16, wherein the slats 21 and the bottom end portion 22 are fully closed with their front side lower than their rear side.

Figure 31B:
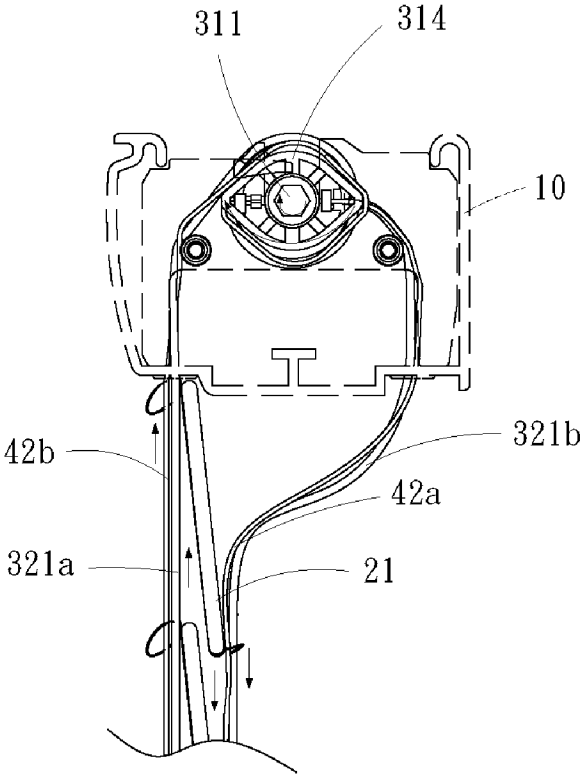
FIG. 31B is a right side view of FIG. 31A.
Figure 31A:
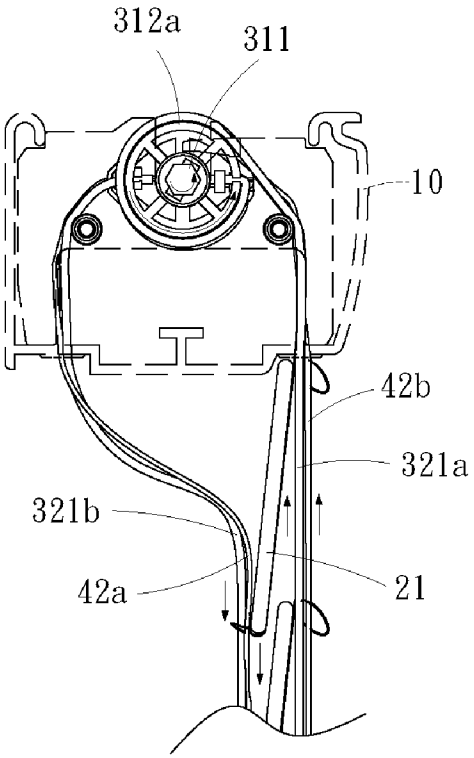
FIG. 31A is a partial left side view of the window blind of the third embodiment of the present disclosure, showing the arrangement of the rotating shaft assembly when the slats of the slat assembly are fully closed in a manner that the front side of each slat is higher than the rear side thereof.

As shown in FIG. 31A and FIG. 31B (and with FIG. 19 used as a reference), when the control member 34 is driven to rotate in another direction indicated in these drawings, the rotating shaft 311 would be driven to rotate the first rotating member 312*a* and the cord rotating drum 314 counterclockwise if seen in the left side view FIG. 31A. Similarly, the rotation of the rotating shaft 311 would drive the first rotating member 312*a* and the cord rotating drum 314 to rotate together all the way, whereby to simultaneously drive the rear warp 321*b* of the ladder 321 and the first cord 42*a* to move downward, and to drive the front warp 321*a* and the second cord 42*b* to move upward, driving the slats 21 and the bottom end portion 22 to gradually rotate together in a manner that their front side goes upward and their rear side goes downward. Furthermore, similar to what was described above, the first cord 42*a* and the second cord 42*b* could, just like the rear warp 321*b* and the front warp 321*a*, create a relative vertical movement during the whole rotation process of the rotating shaft 311, so that the bottom end portion 22 could have the same tilting angle as the slats 21, and therefore the window blind could become the state shown in FIG. 19, wherein the slats 21 and the bottom end portion 22 are fully closed in a manner that their front side is higher than their rear side.

It needs to be clarified that, the first rotating member 312*a* and the cord rotating drum 314 can have slight different perimeters, as long as they can make the first cord 42*a* and the second cord 42*b* create a relative vertical movement along with the rear warp 321*b* and the front warp 321*a* while being rotated by the rotating shaft 311, for this capability could overcome the restriction imposed on the bottom end portion 22 by the fixed-length first cord 42*a* and second cord 42*b*, and therefore could improve the closing effect of the slat assembly 20. However, it would be preferable to have equal perimeters, so that the relative moving distance between the first cord 42*a* and the second cord 42*b* caused by the rotation of the rotating shaft 311 could be the same as that between the rear warp 321*b* and the front warp 321*a*.

Figure 32:
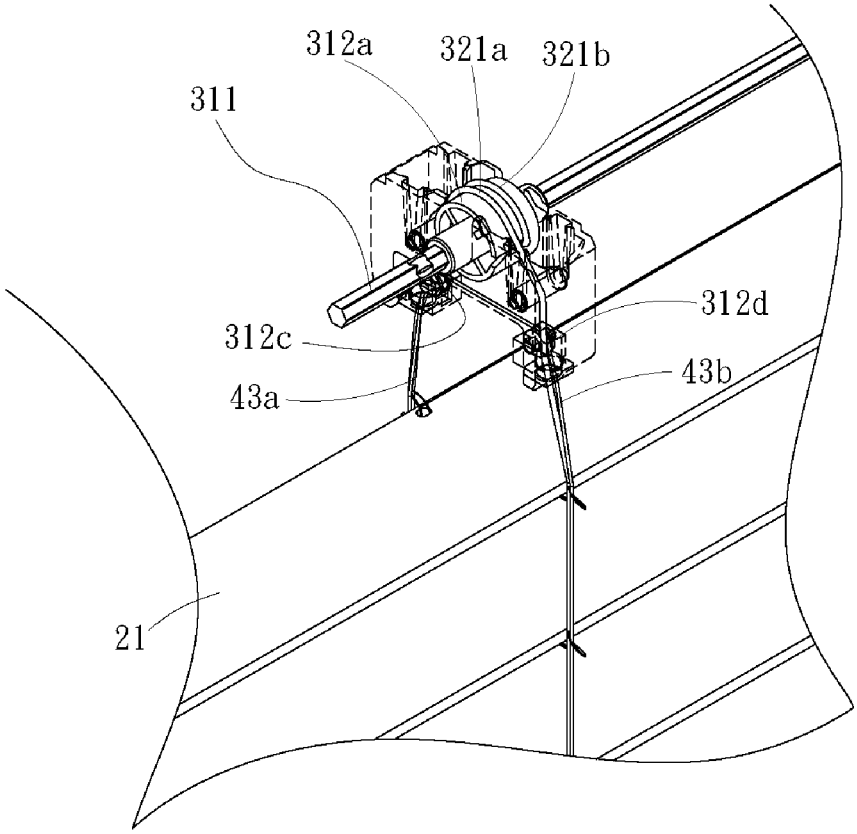
FIG. 32 is a partial schematic view of the window blind of a fourth embodiment of the present disclosure, showing the arrangement of the rotating shaft assembly when the slat assembly is fully expanded and the slats are horizontally arranged.

A fourth embodiment of the present disclosure is shown in FIG. 32 to FIG. 35, which discloses a rotating shaft assembly different from those disclosed in previous embodiments. FIG. 2 can be used as a reference, for FIG. 32 is viewed from an angle similar to FIG. 2. The fourth embodiment has roughly the same structure as the first embodiment, and also includes a housing 10, a slat assembly 20, a slat angle adjusting device 30, and a cord assembly 40. Furthermore, top ends of a front warp 321*a* and a rear warp 321*b* of a ladder 321 of a ladder assembly 32 are connected to a first rotating member 312*a*, while top ends of a front warp 322*a* and a rear warp 322*b* of another ladder 322 are connected to the second rotating member 312*b*. In addition, a first cord 43*a* and a second cord 43*b* are also correspondingly provided in a rear side and a front side of the slats 21, respectively corresponding to the rear warp 321*b* and the front warp 321*a*. The fourth embodiment is different from previous embodiments in that, a third rotating member 312*c* and a fourth rotating member 312*d* thereof are neither integrally made nor coaxially provided, but are respectively provided at positions in the housing 10 different from the position of the first rotating member 312*a*.

Figure 33:
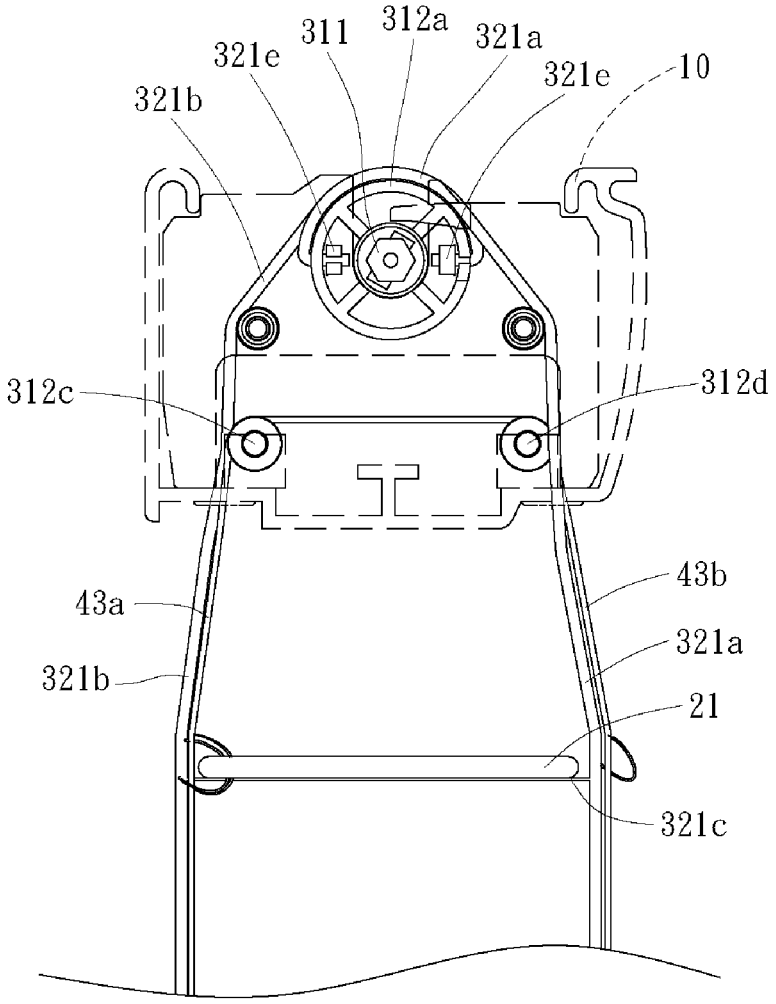
FIG. 33 is a left side view of FIG. 32.

As shown in FIG. 32 and FIG. 33, the third rotating member 312*c* and the fourth rotating member 312*d* are located in the housing 10, one in front of the other, and are near the first rotating member 312*a*. Top ends of the first cord 43*a* and the second cord 43*b* are connected so that the first cord 43*a* and the second cord 43*b* are in effect one single cord, which straddles the third rotating member 312*c* and the fourth rotating member 312*d* at the same time, whereby segments of the first cord 43*a* and the second cord 43*b* near the top ends thereof pass by the third rotating member 312*c* and the fourth rotating member 312*d*, respectively. Similar to the second embodiment, the first cord 43*a* and the second cord 43*b* bear the weight of the bottom end portion 22 (and the slats 21), and therefore press against the third rotating member 312*c* and the fourth rotating member 312*d*. When the first cord 43*a* and the second cord 43*b* move, the third rotating member 312*c* and the fourth rotating member 312*d* would be driven to rotate together. In other words, the movement of the first cord 43*a* and the second cord 43*b*, which is relative to the housing 10, would not be interfered with or hindered by the third rotating member 312*c* and the fourth rotating member 312*d*. Understandably, if the third rotating member 312*c* and the fourth rotating member 312*d* are replaced by pins or rods made of certain materials which are smooth enough to make the friction between these components and the first cord 43*a* and the second cord 43*b* negligible, the objective of not interfering with or hindering the movement of the first cord 43*a* and the second cord 43*b* relative to the housing 10 could be still achieved. When the slat assembly 20 is fully expanded and the slats 21 are arranged in the horizontal state shown in FIG. 1 and FIG. 33, segments of the front warp 321*a* and the rear warp 321*b* of the ladder 321 located in the housing 10 have roughly the same lengths, and lengths of the first cord 43*a* and the second cord 43*b* are also roughly the same.

Figure 34:
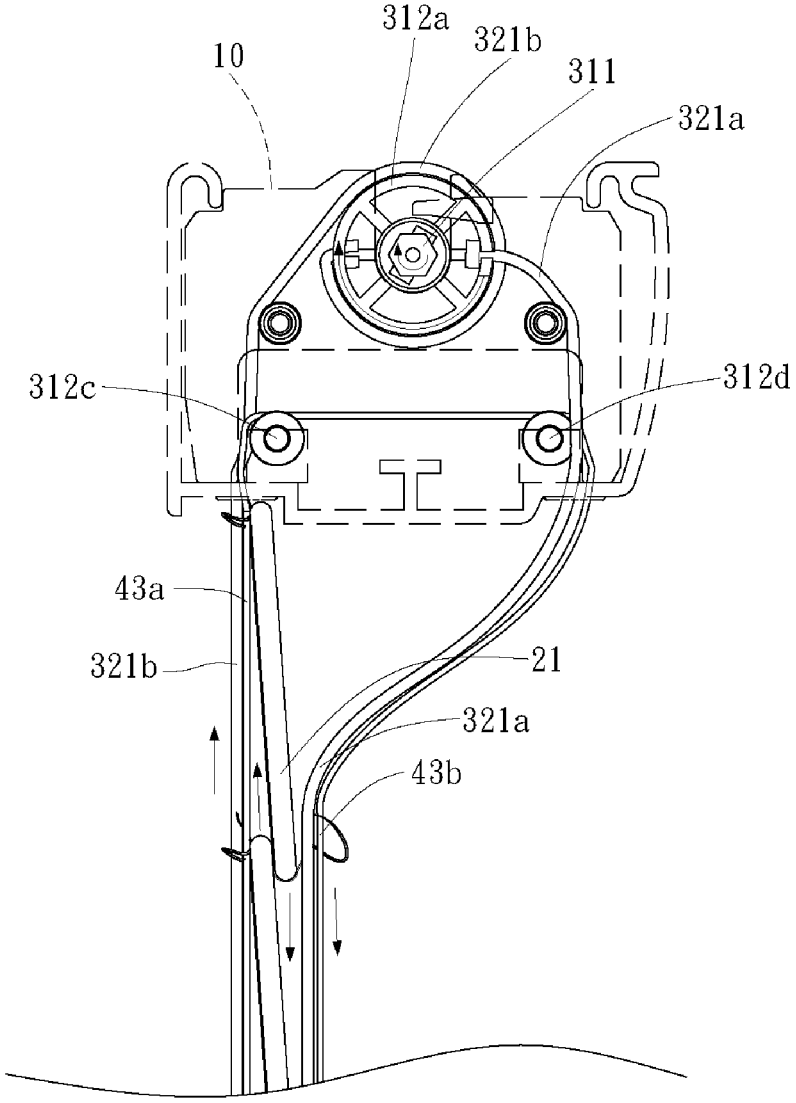
FIG. 34 is a partial left side view of the window blind of the fourth embodiment of the present disclosure, showing the arrangement of the rotating shaft assembly when the slats of the slat assembly are fully closed in a manner that the rear side of each slat is higher than the front side thereof.

As shown in FIG. 34 (and FIG. 16, which is used as a reference), when the control member 34 is driven to rotate in a direction indicated in the drawing, the rotating shaft 311 would be driven to rotate the first rotating drum 312. In the current embodiment, the rotating shaft 311 would be rotated clockwise in this circumstance. Furthermore, the rotation of the rotating shaft 311 would drive the first rotating member 312*a* to rotate throughout the process to make the rear warp 321*b* of the ladder 321 move upward and the front warp 321*a* move downward. When the front warp 321*a* and rear warp 321*b* move, the bottom end portion 22 would be driven to rotate at the same time, in a manner that the front side thereof goes downward and the rear side thereof goes upward. When the front warp 321*a* and the rear warp 321*b* create a relative vertical movement to drive the bottom end portion 22 to rotate, the bottom end portion 22 would also drive the first cord 43*a* and the second cord 43*b* to correspondingly create a relative vertical movement at the same time, since bottom ends of the first cord 43*a* and the second cord 43*b* are connected to the bottom end portion 22. In addition, if the first cord 43*a* and the second cord 43*b* respectively contact the corresponding rear warp 321*b* or front warp 321*a*, the first cord 43*a* and the second cord 43*b* would have friction generated between itself and the corresponding rear warp 321*b* or the front warp 321*a*, which would facilitate the first cord 43*a* and the second cord 43*b* to move along with the rear warp 321*b* and the front warp 321*a* when they are creating a relative vertical movement. In this way, the first cord 43*a* and the second cord 43*b* would also have a relative vertical movement along with the rotation of the rotating shaft 311 more immediately and synchronously. Whereby, the bottom end portion 22 would have the same tilting angle as the slats 21 without being interfered with or hindered by the fixed-length first cord 43*a* and second cord 43*b*. Eventually, the window blind could become the state shown in FIG. 16, wherein the slats 21 and the bottom end portion 22 are fully closed, with their front side lower than their rear side.

Figure 35:
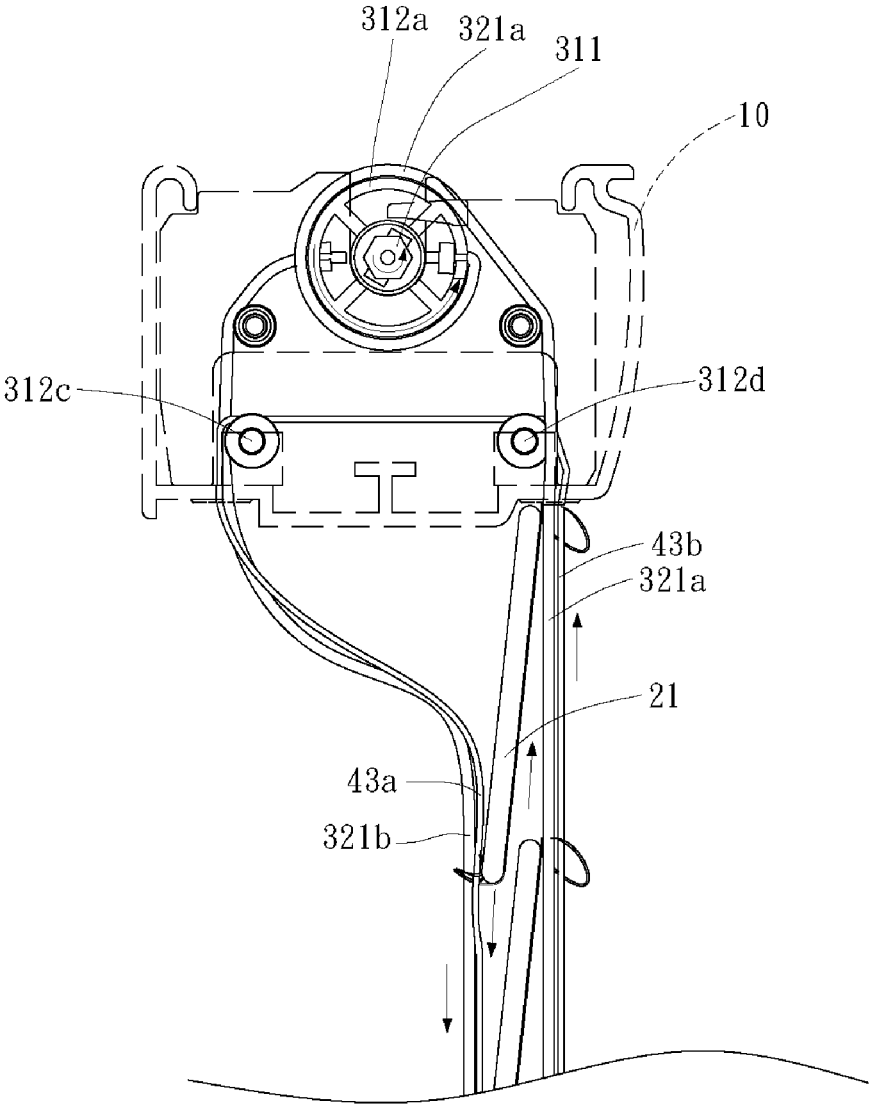
FIG. 35 is a partial left side view of the window blind of the fourth embodiment of the present disclosure, showing the arrangement of the rotating shaft assembly when the slats of the slat assembly are fully closed in a manner that the front side of each slat is higher than the rear side thereof.

As shown in FIG. 35 (and in FIG. 19, which is used as a reference), when the control member 34 is maneuvered to rotate in another direction, the rotating shaft 311 would drive the first rotating member 312*a* to rotate counterclockwise. Similarly, the rotation of the rotating shaft 311 would drive the first rotating member 312*a* to rotate together throughout the process, whereby to drive the rear warp 321*b* of the ladder 321 to move downward and the front warp 321*a* to move upward. Consequently, the first cord 43*a* and the second cord 43*b* would create a relative vertical movement corresponding to the tilting angle of the bottom end portion 22. In other words, the first cord 43*a* could move downward along with the rear warp 321*b*, and the second cord 43*b* could move upward along with the front warp 321*a*, whereby the slats 21 and the bottom end portion 22 could rotate together in a manner that their front side goes upward and their rear side goes downward, which could eventually make the bottom end portion 22 to have the same tilting angle as the slats 21, and the window blind could therefore become the state shown in FIG. 19, wherein the slats 21 and the bottom end portion 22 are fully closed with their front side higher than their rear side.

With the arrangements of the cords and the rotating shaft assemblies disclosed in previously mentioned embodiments, the slats could be truly fully closed, and the problem of irregular light leakage which may happen on lateral sides of the slat assembly due to misaligned slats could be prevented. Furthermore, the bottom end portion could be rotated properly in spite of the fact that the lengths of the cords are fixed, and this capability could improve the problem that slats near the bottom end portion may be incompletely closed when the slats are to be fully closed. In addition, through the structures and the arrangements disclosed in the present disclosure, the slats and the bottom end portion of the slat assembly could rotate throughout the duration when the rotating shaft is being driven to rotate, so that the angle of the bottom end portion could be changed along with the slats in a gentler and smoother manner till the window blind reaches the completely closed state.

It must be pointed out again that the embodiments described above are only some preferred embodiments of the present disclosure. All equivalent structures and methods which employ the concepts disclosed in this specification and the appended claims should fall within the scope of the present disclosure.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A window blind, comprising:

a housing, which is defined to have a longitudinal axis, a lateral axis, and a vertical axis, wherein the longitudinal axis and the lateral axis are perpendicular to each other, and are both on a same horizontal plane; the vertical axis is perpendicular to the longitudinal axis, and is in a same direction as a normal of the horizontal plane; the longitudinal axis passes through lateral sides of the housing, the lateral axis passes through front and rear sides of the housing, and the vertical axis passes through top and bottom sides of the housing;

a slat assembly provided below the housing, wherein the slat assembly comprises a plurality of slats and a bottom end portion; the bottom end portion is located below the slats so that the slats are between the bottom end portion and the housing; and a slat angle adjusting device, which comprises:

a rotating shaft assembly provided in the housing and parallel to the longitudinal axis;

a ladder assembly comprising at least two ladders, wherein each of the ladders has a front warp and a rear warp, and both the front warp and the rear warp are provided in a direction parallel to the vertical axis and are spaced apart from each other; a plurality of wefts are provided at intervals between the front warp and the rear warp, making each of the ladders have a ladder shape; each of the wefts is provided with one of the slats, so that the slats are arranged in the direction parallel to the vertical axis at intervals between the front warp and the rear warp; the front warp and the rear warp are connected to the rotating shaft assembly to be driven by the rotating shaft assembly to create a relative movement in the direction parallel to the vertical axis, whereby to drive the slats to turn;

a first cord passing on one of a front side and a rear side of the slats, wherein a top end of the first cord is concurrently movable along with the rotating shaft assembly, and a bottom end of the first cord is connected to the bottom end portion; when the rotating shaft assembly is driven to rotate in a first direction, the first cord and the front warps or the rear warps of the ladder assembly which is on a same side as the first cord are concurrently reeled into the housing throughout a rotation of the rotating shaft assembly, and the slats and the bottom end portion are also concurrently rotated throughout the rotation of the rotating shaft assembly, when the rotating shaft assembly is driven to rotate in a second direction, the first cord and the front warps or the rear warps of the ladder assembly which is on the same side as the first cord are concurrently released out from the housing throughout the rotation of the rotating shaft assembly, and the slats and the bottom end portion are also concurrently rotated throughout the rotation of the rotating shaft assembly;

a second cord, wherein the second cord passes on the other one of the front side and the rear side of the slats opposite to the first cord; a top end of the second cord is concurrently movable along with the rotating shaft assembly, and a bottom end of the second cord is connected to the bottom end portion of the slat assembly; when the rotating shaft assembly is driven to rotate in the second direction, the second cord and the front warps or the rear warps of the ladder assembly which is on a same side as the second cord are concurrently reeled into from the housing throughout the rotation of the rotating shaft assembly, when the rotating shaft assembly is driven to rotate in the first direction, the second cord and the front warps or the rear warps of the ladder assembly which is on a same side as the second cord are concurrently released out from the housing throughout the rotation of the rotating shaft assembly; and a lifting device provided at the bottom end portion, wherein the bottom end of the first cord and the bottom end of the second cord are connected to the lifting device; when the bottom end portion is moved in a direction of the vertical axis, the lifting device synchronously releases out or retracts the first cord and the second cord along with a movement of the bottom end portion;

wherein the rotating shaft assembly comprises a rotating shaft, a first rotating member, a second rotating member, a third rotating member, and a fourth rotating member; top ends of the front warp and the rear warp of one of the ladders are connected to the first rotating member and wound around a surface of the first rotating member, and the front warp and the rear warp of the one of the ladders are concurrently movable along with the first rotating member, while top ends of the front warp and the rear warp of another one of the ladders are connected to the second rotating member and wound around a surface of the second rotating member, and the front warp and the rear warp of the another one of the ladders are concurrently movable along with the second rotating member; the top end of the first cord is connected to the third rotating member and wound around a surface of the third rotating member, and the top end of the first cord is concurrently movable along with the third rotating member; the top end of the second cord is connected to the fourth rotating member and wound around a surface of the fourth rotating member, and the top end of the second cord is concurrently movable along with the fourth rotating member; when the rotating shaft is driven to rotate, the first rotating member, the second rotating member, the third rotating member, and the fourth rotating member are rotated along with a rotation of the rotating shaft.

2. The window blind of claim 1, wherein the rotating shaft is located in the housing in a direction parallel to the longitudinal axis; the first rotating member, the second rotating member, and the third rotating member are provided in a manner that each of them is concurrently movable along with the rotating shaft.

3. The window blind of claim 2, wherein the slat angle adjusting device further comprises a direction-changing mechanism and a control member; the direction-changing mechanism is located in the housing, and is connected to the rotating shaft; the control member is exposed out of the housing; the control member is adapted to be operated to drive the direction-changing mechanism to move, whereby to drive the rotating shaft to rotate.

4. The window blind of claim 2, wherein the third rotating member and the first rotating member are integrally made as a first rotating drum.

5. The window blind of claim 4, wherein the first rotating drum has a first tube body and a first axial passage that goes through the first tube body; the rotating shaft passes through the first axial passage; a shape of a cross-section of the rotating shaft matches a shape of a cross-section of the first axial passage, which are both non-circular; a first engaging slot and a second engaging slot are provided on the first tube body in a direction substantially parallel to the longitudinal axis; the first engaging slot and the second engaging slot are respectively located on opposite sides of the first tube body; the top end of the front warp of the one of the ladders is engaged in the first engaging slot; the top end of the rear warp of the one of the ladders and the top end of the first cord are engaged in the second engaging slot.

6. The window blind of claim 5, wherein each of the first engaging slot and the second engaging slot has an open end and a closed end; the open end of the first engaging slot is at an end of the first tube body, and the open end of the second engaging slot is at another end of the first tube body.

7. The window blind of claim 1, wherein at least one of the ladders has a plurality of thread loops provided on one of the front warp and the rear warp; each of the slats has a perforation corresponding to one of the thread loops; the first cord, in the direction parallel to the vertical axis, sequentially passes through all of the thread loops, each of which has passed through the corresponding one of the perforations, whereby to restrict the slats from moving relative to the ladder assembly in directions parallel to the longitudinal axis.

8. The window blind of claim 1, wherein the slat angle adjusting device further comprises a direction-changing mechanism and a control member; the direction-changing mechanism is located in the housing, and is connected to the rotating shaft; the control member is exposed out of the housing; the control member is adapted to be operated to drive the direction-changing mechanism to move, whereby to drive the rotating shaft to rotate.

9. The window blind of claim 1, wherein the third rotating member and the first rotating member are integrally made as a first rotating drum.

10. The window blind of claim 9, wherein the first rotating drum has a first tube body and a first axial passage that goes through the first tube body; the rotating shaft passes through the first axial passage; a shape of a cross-section of the rotating shaft matches a shape of a cross-section of the first axial passage, which are both non-circular; a first engaging slot and a second engaging slot are provided on the first tube body in a direction substantially parallel to the longitudinal axis; the first engaging slot and the second engaging slot are respectively located on opposite sides of the first tube body; the top end of the front warp of the one of the ladders is engaged in the first engaging slot; the top end of the rear warp of the one of the ladders is engaged in the second engaging slot; the top end of the first cord is engaged in one of the first engaging slot and the second engaging slot.

11. The window blind of claim 10, wherein each of the first engaging slot and the second engaging slot has an open end and a closed end; the open end of the first engaging slot is at an end of the first tube body, and the open end of the second engaging slot is at another end of the first tube body.

12. The window blind of claim 1, wherein the third rotating member, the fourth rotating member, and the first rotating member are integrally made as a first rotating drum.

13. The window blind of claim 12, wherein, in the first rotating drum, the third rotating member and the fourth rotating member are connected; the top end of the first cord and the top end of the second cord are connected; the front warp and the rear warp of the one of the ladders are respectively provided at the first rotating member in a non-movable manner; a segment of the first cord near the top end thereof is wound around the third rotating member in a manner that said segment is non-movable relative to the third rotating member; a segment of the second cord near the top end thereof is wound around the fourth rotating member in a manner that said segment is non-movable relative to the fourth rotating member; when the rotating shaft is driven to rotate, the first rotating drum drives the first cord and the second cord to create a relative movement along with the front warps and the rear warps which also have a relative movement.

14. The window blind of claim 12, wherein the first rotating drum has a first tube body and a first axial passage that goes through the first tube body; the rotating shaft passes through the first axial passage; a shape of a cross-section of the rotating shaft matches a shape of a cross-section of the first axial passage, which are both non-circular; a first engaging slot and a second engaging slot are provided on the first tube body in a direction substantially parallel to the longitudinal axis; the first engaging slot and the second engaging slot are respectively located on opposite sides of the first tube body; the top end of the front warp of the one of the ladders is engaged in the first engaging slot; the top end of the rear warp of the one of the ladders is engaged in the second engaging slot; the top end of the first cord is engaged in one of the first engaging slot and the second engaging slot.

15. The window blind of claim 14, wherein each of the first engaging slot and the second engaging slot has an open end and a closed end; the open end of the first engaging slot is at an end of the first tube body, and the open end of the second engaging slot is at another end of the first tube body.

16. The window blind of claim 1, wherein the third rotating member and the first rotating member are integrally made as a first rotating drum, while the second rotating member and the fourth rotating member are integrally made as a second rotating drum.

17. The window blind of claim 16, wherein the first rotating drum has a first tube body and a first axial passage that goes through the first tube body; the rotating shaft passes through the first axial passage; a shape of a cross-section of the rotating shaft matches a shape of a cross-section of the first axial passage, which are both non-circular; a first engaging slot and a second engaging slot are provided on the first tube body in a direction substantially parallel to the longitudinal axis; the first engaging slot and the second engaging slot are respectively located on opposite sides of the first tube body; the top end of the front warp of the one of the ladders is engaged in the first engaging slot; the top end of the rear warp of the one of the ladders is engaged in the second engaging slot; the top end of the first cord is engaged in one of the first engaging slot and the second engaging slot.

18. The window blind of claim 17, wherein each of the first engaging slot and the second engaging slot has an open end and a closed end; the open end of the first engaging slot is at an end of the first tube body, and the open end of the second engaging slot is at another end of the first tube body.

19. The window blind of claim 1, wherein the top end of the first cord and the top end of the second cord are connected; the first cord passes by the third rotating member, and the second cord passes by the fourth rotating member; when the rotating shaft is driven to rotate, the first cord and the second cord create a relative movement along with the front warps and the rear warps which also have a relative movement.

20. The window blind of claim 1, wherein the third rotating member and the fourth rotating member are integrally made to form a cord rotating drum; when the rotating shaft is driven to rotate, the cord rotating drum, the first rotating member, and the second rotating member are rotated along with the rotating shaft to make the front warps and the rear warps of the ladder assembly create a relative movement, and to drive the first cord and the second cord to create a relative movement as well.

21. The window blind of claim 1, wherein the lifting device comprises a power assembly and a cord reeling assembly; the power assembly is concurrently movable along with the cord reeling assembly; the bottom end of the first cord and the bottom end of the second cord are respectively connected to the cord reeling assembly; when the bottom end portion is moved in the direction of the vertical axis, the power assembly drives the cord reeling assembly to release out or retract the first cord and the second cord.

22. The window blind of claim 21, wherein the power assembly comprises a driving wheel, a spiral torsion spring, and a spring receiving spool; the driving wheel and the spring receiving spool are parallel to and spaced apart from each other; two ends of the spiral torsion spring are respectively connected to the driving wheel and the spring receiving spool, so that the spiral torsion spring is adapted to be wound around the driving wheel and the spring receiving spool; the cord reeling assembly comprises at least one cord reel; the bottom end of the first cord and the bottom end of the second cord are respectively connected to the at least one cord reel; the driving wheel is concurrently movable along with the at least one cord reel; when the bottom end portion is moved downward in the direction of the vertical axis, the at least one cord reel is rotated to synchronously release out the first cord and the second cord, and the driving wheel is driven by a rotation of the at least one cord reel to rotate at the same time, so that the spiral torsion spring is released from the spring receiving spool to start winding around the driving wheel; when the bottom end portion is moved upward in the direction of the vertical axis, the spiral torsion spring is released from the driving wheel to start winding around the spring receiving spool, so that the driving wheel synchronously drives the at least one cord reel to retract the first cord and the second cord.

* * * * *